United States Patent [19]

Iino et al.

[11] Patent Number: 4,810,606

[45] Date of Patent: Mar. 7, 1989

[54] PHOTOSENSITIVE MEMBER COMPRISING CHARGE GENERATING LAYER AND CHARGE TRANSPORTING LAYER

[75] Inventors: Shuji Iino, Hirakata; Hideo Hotomi, Suita; Isao Doi, Toyonaka; Mitsutoshi Nakamura, Osaka; Izumi Osawa, Ikeda, all of Japan

[73] Assignee: Minolta Camera Kabushiki Kaisha, Osaka, Japan

[21] Appl. No.: 69,610

[22] Filed: Jul. 2, 1987

[30] Foreign Application Priority Data

| | | | |
|---|---|---|---|
| Jul. 7, 1986 | [JP] | Japan | 61-159216 |
| Jul. 7, 1986 | [JP] | Japan | 61-159218 |
| Sep. 8, 1986 | [JP] | Japan | 61-210883 |

[51] Int. Cl.[4] ..... G03G 5/085

[52] U.S. Cl. ..... 430/58; 430/84; 430/95

[58] Field of Search ..... 430/58, 84, 95

[56] References Cited

U.S. PATENT DOCUMENTS

| | | | |
|---|---|---|---|
| 3,956,525 | 5/1976 | Yasuba | 427/41 |
| 4,366,208 | 12/1982 | Akai et al. | 428/421 |
| 4,376,688 | 3/1983 | Ceasar et al. | 204/192.11 |
| 4,416,755 | 11/1983 | Ceasar et al. | 204/192.11 |
| 4,490,450 | 12/1984 | Shimizu et al. | 430/57 |
| 4,495,262 | 1/1985 | Matsuzaki et al. | 430/58 |
| 4,510,224 | 4/1985 | Yamazaki et al. | 430/57 |
| 4,518,670 | 4/1985 | Matsuzaki et al. | 430/58 |
| 4,544,617 | 10/1985 | Mort et al. | 430/58 |
| 4,557,987 | 12/1985 | Shirai et al. | 430/58 |
| 4,579,801 | 4/1986 | Yashiki | 430/60 |
| 4,634,648 | 1/1987 | Jansen et al. | 430/95 |
| 4,675,265 | 6/1987 | Kazama et al. | 430/66 |

FOREIGN PATENT DOCUMENTS

| | | |
|---|---|---|
| 50-30526 | 3/1975 | Japan . |
| 51-46130 | 4/1976 | Japan . |
| 54-115134 | 9/1979 | Japan . |
| 55-86169 | 6/1980 | Japan . |
| 56-60447 | 5/1981 | Japan . |
| 59-28161 | 2/1984 | Japan . |
| 59-38753 | 3/1984 | Japan . |
| 59-136742 | 8/1984 | Japan . |
| 59-214859 | 12/1984 | Japan . |
| 61-761 | 4/1985 | Japan . |
| 60-63541 | 4/1985 | Japan . |
| 60-61761 | 4/1985 | Japan . |
| 61-94056 | 5/1986 | Japan . |
| 61-289355 | 12/1986 | Japan . |

OTHER PUBLICATIONS

Journal of Applied Polymer Science, vol. 17, 1973.

"A C-nmr Investigation of Plasma Polymerized Ethane, Ethylene, and Acetylene" Dilks et al., Journal of Polymer Science, vol. 19, 1981.

*Primary Examiner*—John L. Goodrow

*Attorney, Agent, or Firm*—Burns, Doane, Swecker & Mathis

[57] ABSTRACT

A photosensitive member of the present invention comprises an electrically conductive substrate, a charge generating layer and a charge transporting layer comprising amorphous carbon which contains hydrogen.

The charge transporting layer contains about 0.1 to about 7 atomic % of oxygen and/or about 0.1 to about 5 atomic % of nitrogen based on all the constituent atoms therein.

The photosensitive member of this construction is excellent in electrophotographic characteristics inclusive of charge transportability and charging ability.

6 Claims, 3 Drawing Sheets

PHOTOSENSITIVE MEMBER COMPRISING CHARGE GENERATING LAYER AND CHARGE TRANSPORTING LAYER

BACKGROUND OF THE INVENTION

1. Field of the Invention

The present invention relates to a photosensitive member of the function-separated type comprising a hydrogen-containing amorphous silicon layer as a charge transporting layer.

2. Description of the Prior Art

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, selenium-arsenic, selenium-tellurium, zinc oxide, amorphous silicon and the like, and organic compounds such as polyvinylcarbazole, metal phthalocyanine, disazo pigments, tris-azo pigments, perillene pigments, triphenylmethanes, triphenylamines, hydrazones, styryl compounds, pyrazolines, oxazoles, oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials except for amorphous silicon (a-Si) are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning, whereas the foregoing organic compounds have poor durability and many unstable properties.

In order to eliminate these drawbacks, progress has been made in recent years in the application of a-Si formed by the glow discharge process to electrophotographic photosensitive members as a material with reduced harmfulness and higher durability. Nevertheless, a-Si is hazardous to manufacture since it requires highly ignitable silane gas as its starting material. Moreover, a-Si requires a large quantity of silane gas which is expensive, rendering the resulting photosensitive member exceedingly more costly than conventional photosensitive members. The manufacture of photosensitive members of a-Si involves many disadvantages. For example, a-Si is low in film-forming speed and releases a large amount of explosive undecomposed silane products in the form of particles when forming a film. Such particles, when incorporated into the photosensitive member being produced, gives a seriously adverse influence on the quality of images to be obtained. Further a-Si has a low chargeability due to its original high relative dielectric constant. This necessitates the use of a charger of higher output for charging the a-Si photosensitive member to a predetermined surface potential in the copying apparatus.

On the other hand, it has been proposed in recent years to use plasma-polymerized organic films for photosensitive members.

Plasma-polymerized organic films per se have been well-known for a long time. In Journal of Applied Polymer Science, Vol. 17, pp. 885–892, 1973, for example M. Shen and A. T. Bell state that a plasma-polymerized organic film can be produced from the gas of any organic compound. The same authors discuss film formation by Plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm like usual polyethylene films, or are used as recognized at least as such. The use of the film for electrophotographic photosensitive members is based also on the same concept; the film has found limited use only as an undercoat or overcoat serving solely as a protective layer, adhesion layer, blocking layer or insulating layer.

For example, Unexamined Japanese patent publication SHO No. 59-28161 discloses a photosensitive member which comprises a plasma-polymerized high polymer layer of reticular structure formed on a substrate and serving as a blocking-adhesion layer, and an a-Si layer formed on the polymer layer. Unexamined Japanese patent publication SHO No. 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ ohm-cm. Unexamined Japanese patent publication SHO No. 59-136742 discloses a photosensitive member wherein an aluminum substrate is directly coated with a carbon film having a thickness of about 1 to about 5 μm and serving as a protective layer for preventing aluminum atoms from diffusing through an a-Si layer formed over the substrate when the member is exposed to light. Unexamined Japanese patent publication SHO No. 60-63541 discloses a photosensitive member wherein a diamond-like carbon film, 200 angstroms to 2 μm in thickness, is interposed between an aluminum substrate and an overlying a-Si layer to serve as an adhesion layer to improve the adhesion between the substrate and the a-Si layer. The publication says that the film thickness is preferably up to 2 μm in view of the residual charge.

These disclosed inventions are all directed to a so-called undercoat provided between the substrate and the a-Si layer. In fact, these publications mention nothing whatever about charge transporting properties, nor do they offer any solution to the foregoing substantial problems of a-Si.

Furthermore, U.S. Pat. No. 3,956,525, for example, discloses a photosensitive member of the polyvinylcarbazole-selenium type coated with a polymer film having a thickness of 0.1 to 1 μm and formed by glow discharge polymerization as a protective layer. Unexamined Japanese patent publication SHO No. 59-214859 discloses a technique for protecting the surface of an a-Si photosensitive member with an approximately 5-μm-thick film formed by plasma-polymerizing an organic hydrocarbon monomer such as styrene or acetylene. Unexamined Japanese patent publication SHO No.

60-61761 discloses a photosensitive member having a diamond-like carbon thin film 500 angstroms to 2 μm in thickness and serving as a surface protective layer, it being preferred that the film thickness be up to 2 μm in view of trasmittancy. Unexamined Japanese patent publication SHO No. 60-249115 discloses a technique for forming a film of amorphous carbon or hard carbon with a thickness of about 0.05 to about 5 μm for use as a surface protective layer. The publications states that the film adversely affects the activity of the protected photosensitive member when exceeding 5 μm in thickness.

These disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese patent publication SHO No. 51-46130 discloses an electrophotographic photosensitive member of the polyvinylcarbazole type which has a polymer film 0.001 to 3 μm in thickness and formed on its surface by being subjected to glow discharge polymerization. Nevertheless, the publication is totally mute about charge transporting properties, further failing to solve the foregoing substantial problems of a-Si.

Thus, the conventional plasma-polymerized organic films for use in electrophotographic photosensitive members are used as undercoats or overcoats because of their insulating properties and need not have a carrier transporting function. Accordingly, the films used are limited in thickness to a very small value of up to about 5 μm if largest. Carriers pass through the film owing to a tunnel effect, while if the tunnel effect is not expectable, the film used has such a small thickness that will not pose problems actually as to the occurrence of a residual potential.

With electrophotographic photosensitive members of the function-separated type, the charge transporting layer must have high ability to transport carriers and needs to be at least $10^{-7}$ $cm^2/V/sec$ in carrier mobility. Further to be satisfactorily usable in electrophotographic systems, the charge transporting layer must have excellent charging characteristics and be capable of withstanding a voltage of 10 V/μm. It is also desired that the charge transporting layer be up to 6 in specific dielectric constant to lessen the load on the charger.

SUMMARY OF THE INVENTION

In view of the foregoing problems, the main object of the present invention is to provide a photosensitive member which is generally excellent in electrophotographic characteristics and capable of giving satifactory images.

Another object of the invention is to provide a photosensitive member which is excellent in charge transportability and in charging characteristics.

Another object of the invention is to provide a photosensitive member which is free of a reduction in sensitivity and of residual potential and which retains sensitivity with high stability despite lapse of time.

Another object of the invention is to provide a photosensitive member which is excellent in durability, weather resistance, resistance to environmental pollution and light transmitting property.

These and other objects of the invention can be fulfilled by providing a photosensitive member which comprises a substrate, a charge generating layer and a charge transporting layer of amorphous carbon, the charge transporting layer having a relative dielectric constant of 2.0 to 6.0 and containing 0.1 to 67 atomic % of hydrogen based on the combined amount of carbon and hydrogen contained in the transporting layer and 0.1 to 5 atomic % of nitrogen atoms and/or 0.1 to 7.0 atomic % of oxygen atoms based on all the constituent atoms of the transporting layer.

DETAILED DESCRIPTION OF THE INVENTION

Figure 1:
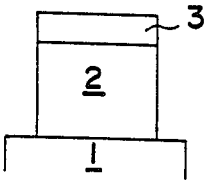
FIGS. 1 to 6 are diagrams showing photosensitive members embodying the invention.

The charge transporting layer of the photosensitive member embodying the invention is characterized in that the layer comprises a plasma-polymerized organic layer prepared by a plasma polymerization reaction under low gas pressure and containing at least nitrogen atoms and/or oxygen atoms as a chemically modifying substance or as such substances. The plasma-polymerized organic layer is an amorphous carbon layer (hereinafter referred to as "a-C layer"). It is possible to determine the quantities of carbon atoms, hydrogen atoms, nitrogen atoms and oxygen atoms contained in this layer by usual methods of elementary analysis, such as organic elementary analysis, Auger electron spectroscopy. The charge transporting layer does not exhibit distinct photosensitive properties when exposed to visible light or semiconductor laser beams, but has suitable ability to transport charges with good stability and is excellent in characteristics for use in electrophotographic photosensitive members, e.g., in chargeability, durability and resistance to weather and to environmental pollution, and also in transmittancy. The layer therefore affords a high degree of freedom in providing laminate structures especially for use as photosensitive members of the function-separated type.

We have conducted research on the application of plasma-polymerized organic layers to photosensitive members and found that the polymerized layer, which is originally thought to be an insulating layer, readily exhibits ability to transport charges with a reduced specific resistivity when incorporating a suitable amount of atoms of at least one of nitrogen and oxygen as a chemically modifying substance. Although much still remains to be clarified in detail for the theoretical interpretation of this finding, the result achieved will presumably be attributable to electrons of relatively unstable energy, such as $\pi$-electrons, unpaired electrons, remaining free radicals and the like, which are captured in a charge generating layer and which effectively contribute to charge transportability owing to polarization or a change in a stereo structure or the like due to the presence of nitrogen atoms and/or oxygen atoms.

The polymerized layer, when free from nitrogen and oxygen, is liable to exhibit impaired transportability with the lapse of time after formation, whereas we have found that the presence of a suitable amount of atoms of at least one of nitrogen and oxygen serving as a chemically modifying substance enables the charge transporting layer to retain high transportability with good stability despite the lapse of time.

We have further found that the presence of nitrogen atoms greatly expedites the formation of the charge transporting layer which must have a considerable thickness, as required for efficient preparation of the layer.

According to the present invention, hydrocarbons are used as organic gases for forming the a-C layer. These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentadosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methylallene, butadiene, pentadiene, hexadiene, cyclopentadiene and the like; triolefins such as ocimene, alloocimene, milsene, hexatriene and the like; acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocabons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinene sesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The a-C layer of the present invention contains 0.1 to 67 atomic %, preferably 30 to 60 atomic %, of hydrogen atoms based on the combined amount of carbon and hydrogen atoms present. If the amount of hydrogen atoms is less than 0.1 atomic %, reduced transportability will result, failing to give suitable sensitivity, whereas amounts of hydrogen atoms exceeding 67 atomic % entail reduced chargeability and impaired film-forming ability.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, i.e. the hydrocarbon gases, applying a greater power, decreasing the frequency of the alternating electric field to be set up or increasing the intensity of a d.c. electric field superposed on the alternating electric field.

It is suitable that the a-C layer serving as the charge transporting layer of the invention be 5 to 50 μm, preferably 7 to 20 μm, in thickness for use in the usual electrophotographic process. Thicknesses smaller than 5 μm result in a lower charge potential, failing to give a sufficient copy image density, whereas thicknesses larger than 50 μm are not desirable in view of productivity. The a-C layer is high in transmittancy, dark resistivity and charge transportability, traps no carriers even when not smaller than 5 μm in thickness as mentioned above and contributes to light decay.

According to the invention, nitrogen compounds are used in addition to hydrocarbons in order to incorporate nitrogen atoms into the a-C layer. Such nitrogen compounds need not always be in a gaseous phase at room temperature at atmospheric pressure but can be in a liquid or solid phase provided that they can be vaporized on melting, evaporation or sublimation, for example, when heated or subjected to a vacuum. While nitrogen per se is usable, examples of useful nitrogen compounds include inorganic compounds such as ammonia, organic compounds having a functional group such as an amino group (—$NH_2$) or cyano group (—CN) and nitrogen-containing heterocyclic compounds.

While various organic compounds are usable, examples of those having an amino group are methylamine, ethylamine, propylamine, butylamine, amylamine, hexylamine, heptylamine, octylamine, nonylamine, decylamine, undecylamine, dodecylamine, tridecylamine, tetradecylamine, pentadecylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, aniline, methylaniline, dimethylaniline, ethylaniline, diethylaniline, toluidine, benzylamine, dibenzylamine, tribenzylamine, diphenylamine, triphenylamine, naphthylamine, ethylenediamine, trimethylenediamine, tetramethylenediamine, pentamethylenediamine, hexamethylenediamine, diaminoheptane, diaminooctane, diaminononane, diaminodecane, phenylenediamine and the like. Examples of useful organic compounds having a cyano group are acetonitrile, propionitrile, butyronitrile, valeronitrile, capronitrile, enanthonitrile, caprylonitrile, pelargonnitrile, caprinitrile, lauronitrile, palmitonitrile, stearonitrile, crotononitrile, malonitrile, succinonitrile, glutaronitrile, adiponitrile, benzonitrile, tolunitrile, cyanobenzylic cinnamonitrile, naphthonitrile, cyanopyridine and the like. Examples of useful heterocyclic compounds are pyrrole, pyrroline, pyrrolidine, oxazole, thiazole, imidazole, imidazoline, imidazolidine, pyrazole, pyrazoline, pyrazolidine, triazole, tetrazole, pyridine, piperidine, oxazine, morpholine, thiazine, pyridazine, pyrimidine, pyrazine, piperizine, triazine, indole, indoline, benzoxazole, indazole, benzimidazole, quinoline, cinnoline, phthalazine, phthalocyanine, quinazoline, quinoxaline, carbazole, acridine, phenanthridine, phenazine, phenoxazine, indolizine, quinolizine, guinuclidine, naphthyridine, purine, pteridine, aziridine, azepine, oxadiazine, dithiazine, benzoquinoline, imidazothiazole and the like.

According to the present invnetion, nitrogen atoms, serving as a chemically modifying substance, are incorporated in the a-C layer in an amount of 0.1 to 5.0 atomic %, preferably 0.1 to 3.9 atomic %, based on all the constituent atoms of the layer. Nitrogen atom contents less than 0.1 atomic % fail to assure suitable transportability, result in a lower film-forming velocity and render the resulting layer susceptible to deterioration with time. If the nitrogen atom content exceeds 5.0 atomic %, the nitrogen, which assures satisfactory transportability when present in a smaller amount, conversely acts to give a reduced resistivity to the layer to entail lower chargeability. Thus, the range of nitrogen contents is critical according to the invention.

Further according to the present invention, oxygen compounds are used to incorporate oxygen atoms in the a-C layer. The oxygen compound need not always be in a gasous phase at room temperature at atmospheric pressure but can be a liquid or solid provided that the compound can be vaporized on melting, evaporation or sublimation, for example, when heated or subjected to a vacuum. While oxygen and ozone are usable for this purpose, examples of useful oxygen compounds are inorganic compounds such as water vapor, carbon monoxide, carbon dioxide and carbon suboxide; organic compounds having a functional group or linkage such as hydroxyl group (—OH), aldehyde group (—COH), acyl group (RCO— or —CRO), ketone group (>CO), ether linkage (—O—), ester linkage (—COO—), oxygen-containing heterocyclic ring or the like; etc. Exemplary of useful organic compounds having a hydroxyl group are methanol, ethanol, propanol, butanol, allyl alcohol, fluoroethanol, fluorobutanol, phenol, cyclohexanol, benzyl alcohol, furfuryl alcohol and the like. Examples of useful organic compounds having an aldehyde group are formaldehyde, acetaldehyde, propioaldehyde, butyraldehyde, glyoxal, acrolein, benzaldehyde, furfural and the like. Examples of useful organic compounds having an acyl group are formic acid, acetic acid, propionic acid, butyric acid, valeric acid, palmitic acid, stearic acid, oleic acid, oxalic acid, malonic acid, succinic acid, benzoic acid, toluic acid, salicylic acid, cinnamic acid, naphthoic acid, phthalic acid, furoic acid and the like. Examples of suitable organic compounds having a ketone group are acetone, ethyl methyl ketone, methyl propyl ketone, butyl methyl ketone, pinacolone, diethyl ketone, methyl vinyl ketone, mesityl oxide, methylheptenone, cyclobutanone, cyclopentanone, cyclohexanone, acetophenone, propiophenone, butyrophenone, valerophenone, dibenzyl ketone, acetonaphthone, acetothienone, acetofuron and the like. Examples of useful organic compounds having an ether linkage are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ethyl amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyran, dioxane and the like. Examples of useful organic compounds having an ester linkage are methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate and the like. Examples of useful oxygen-containing heterocyclic compounds are furan, oxazole, furazane, pyran, oxazine, morpholine, benzofuran, benzoxazole, chromene, chroman, dibenzofuran, xanthene, phenoxazine, oxirane, dioxirane, oxathiorane, oxadiazine, benzoisooxazole and the like.

In case of containing oxygen in the a-C layer of the present invention, it is desirable that the a-C layer of the present invention has a ratio of $\alpha_3$ to $\alpha_4$ in an amount of about less than 1.0, more preferably less than 0.8, wherein $\alpha_3$ represents absorption coefficient peak attributed to the carbon-oxygen double bond (>C=O) at about 1700 $cm^{-1}$ and $\alpha_4$ represents absorption coefficient peak attributed to the carbon-carbon double bond (>C=C<) at about 1600 $cm^{-1}$ in the infrared absorption spectrum.

According to the present invention, oxygen atoms, serving as another chemically modifying substance, are incorporated in the a-C layer in an amount of 0.1 to 7.0 atomic %, preferably 0.1 to 4.7 atomic %, based on all the constituent atoms of the layer. If the oxygen atom content exceeds 7.0 atomic %, the oxygen, which assures satisfactory transportability when present in a smaller amount, conversely acts to give a reduced resistivity to the layer to entail lower chargeability. Further in the case of some of oxygen source gases, such as oxygen gas, ozone gas and carbon monoxide gas, the oxygen source gas then produces a marked etching effect, such that an attempt to give an increased oxygen atom content to the a-C layer by supplying the gas at an increased flow rate results in a lower film-forming velocity. This is unfavorable in forming the charge transporting layer which must have a considerable thickness.

The process for producing the a-C layer from a gaseous starting material according to the invention is most preferably such that the gaseous starting material is in the form of a plasma, produced by the d.c., low-frequency, high-frequency, microwave or like plasma process, when forming the layer. Alternatively, the starting material may be converted to ions by the ionization deposition, ion-beam deposition or like process. Further the material may be used in the form of neutral particles produced by the vacuum evaporation, sputtering or like process. Such processes may be used in combination. It is critical that the resulting a-C layer has hydrogen atom, nitrogen atom and oxygen atom contents in the foregoing ranges.

The amount(s) of nitrogen atoms and/or oxygen atoms to be contained in the a-C layer as chemically modifying substance(s) can be controlled primarily by varying the amount(s) of the nitrogen compound and/or the oxygen compound to be introduced into the reactor for plasma polymerization. The use of an increased amount of nitrogen or oxygen compound gives a higher nitrogen or oxygen atom content to the a-C layer of the invention, whereas a decreased amount of the compound results in a lower content.

In this invention, atoms of elements in Group IIIA or Group VA of the Periodic Table may also be incorporated into the a-C layer containing oxygen atoms and/or nitrogen atoms. This gives the layer improved ability to transport both positive and negative carriers, higher sensitivity and greater freedom from residual potential. The content of an element from Group IIIA or VA of the Periodic Table is up to 50,000 atm. ppm, preferably 1,000 to 50,000 atm. ppm, more preferably 5,000 to 20,000 atm. ppm, based on all the constituent atoms of the a-C layer.

According to the present invention, silicon atoms, germanium atoms, tin atoms or chalcogen atoms may further be incorporated into the a-C layer containing oxygen atoms and/or nitrogen atoms. The presence of such hetero atoms imparts to the a-C layer improved ability to transport both positive and negative carriers, further achieving improvements, for example, in the surface smoothness of the photosensitive member, transmittancy and the adhesion between the layer and the substrate. Alternatively, such hetero atoms may be incorporated in order to prepare the photosensitive member with good stability.

For example, when the a-C layer is positioned immediately adjacent to the substrate, it is useful to incorporate oxygen atoms, nitrogen atoms, chalcogen atoms, atoms of an element from Group IV of the Periodic Table, or the like into the a-C layer for giving improved adhesion to the substrate against separation. Further when containing a large amount of silicon atoms or the like, the layer becomes serviceable also as a barrier layer in some cases. The content of such hetero atoms is not limited specifically insofar as the contemplated purpose can be attained. The above-mentioned elements may be used singly or in combination. Depending on the purpose, such atoms may be present locally at a specified position within the charge transporting layer, or may have a concentration distribution.

The a-C layer of the invention is preferably 1.5 to 3.0 eV in optical energy gap Egopt and 2.0 to 6.0 in relative dielectric constant $\epsilon$.

It is thought that a film of small Egopt (less than 1.5 eV) has a large number of levels in the vicinity of band end, i.e. at the lower end of conduction band or upper end of filled band. Accordingly, it is likely that such an a-C layer is not always satisfactorily serviceable as the charge transporting layer of a photosensitive member because of low carrier mobility and shortened life of carriers. When having a great Egopt (greater than 3.0 eV), the a-C layer is liable to form a barrier with the charge generating material and the charge transporting material which are usually used in electrophotography, with the resulting likelihood that carriers will not be smoothly injected into the a-C layer of great Egopt from the charge generating or transporting material. Consequently, the photosensitive member having the a-C layer will not exhibit satisfactory characteristics.

On the other hand, the relative dielectric constant, if greater than 6.0, leads to impaired chargeability and lower sensitivity. An a-C layer of increased thickness appears useful for remedying these properties but is not desirable from the viewpoint of productivity. Preferably, the $\epsilon$ value should not be smaller than 2.0 since lower values permit the layer to exhibit polyethylenical properties or characteristics and lower chargeability.

The charge transporting a-C layer of the present invention does not by itself generate optically excited carriers when exposed to visible light having emission wavelengths of about 450 to 650 nm, to the light from LEDs having emission wavelengths of about 650 to 700 nm or to the light from semiconducter lasers having emission wavelengths of about 750 to 800 nm, i.e., to the light from light sources commonly used in usual electrophotographic processes. Accordingly, even if the a-C layer of the invention as singly provided on an electrically conductive substrate is used for the usual electrophotographic process, the resulting structure fails to form any latent image and is therefore unusable as a photosensitive member. Should the layer be developed by the normal method after an exposure or without exposure, a solid black image only would invariably be obtained.

The charge transporting a-C layer of the present invention functions as a satisfactory photosensitive member only when formed on or beneath a charge generating layer which is capable of efficiently producing optically excited carriers when exposed to the light from a light source such as one mentioned above and which is adapted to efficiently inject the excited carriers into the a-C layer.

Thus, the a-C layer of the invention does not serve as a charge generating layer but functions as a charge transporting layer only.

While research has yet to be made to determine the arrangement of energy bands in the a-C layer before clarifying why the a-C layer of the invention functions as a charge transporting layer but not as a charge generating layer, the reason will presumably be that although the a-C layer, when to be serviceable as a charge generating layer, must permit excitation of carriers through direct transition from the valence band to the conduction band, the energy therefor is not available from light sources of the foregoing wavelength ranges. Nevertheless, in the case where the a-C layer is formed in combination with a charge generating layer which is adapted for efficient excitation of carriers upon exposure to the light of above-mentioned wavelength range, the excited carriers are injected into the a-C layer and thereby smoothly transported without being trapped (because the layer has only a small number of trapping centers or recombination center), consequently assuring suitable light decay.

Whereas the energy bands in the a-C layer of the invention include those of smaller energy than the light of 550 nm (central wavelength of visible light; 2.25 eV), the layer fails to generate optically excited carriers presumably because the Eg (quasi-forbidden band gap) as determined by the energy band measuring method, i.e., by optical absorption, is not always in coincidence with the Eg (true forbidden band gap) actually participating in the generation of carriers in the layer owing to the presence of various impurity levels.

The charge generating layer to be incorporated into the photosensitive member of the present invention is not limited specifically in its meterial. Examples of materials that are usable are inorganic substances such as amorphous selenium, selenium-arsenic, selenium-tellurium, cadmium sulfide, zinc oxide, and amorphous silicon which contains different elements (e.g. hydrogen, boron, carbon, nitrogen, oxygen, fluorine, phosphorus, sulfur, chlorine, bromine, germanium, etc.) for giving altered characteristics, and organic substances such as polyvinylcarbazole, cyanine compounds, metal phthalocyanine compounds, azo compounds, perillene compounds, triarylmethane compounds, triphenylmethane compounds, triphenylamine compounds, hydrazone compounds, styryl compounds, pyrazoline compounds, oxazole compounds, oxazine compounds, oxadiazole compounds, thiazine compounds, xanthene compounds, pyrylium compounds, quinacridone compounds, indigo compounds, polycyclic quinone compounds, disbenzimidazole compounds, indanthrone compounds and squalylium compounds. Other substances are also usable insofar as they are capable of efficiently producing optically excited carriers when exposed to light and efficiently injecting the carriers into the charge transporting layer.

The process for preparing the charge generating layer is not limited specifically. For example, this layer may be formed by the same process as the charge transporting layer (a-C layer) of the invention, electrodeposition in a liquid phase, spraying, dipping or like coating process, or the like. The same process as employed for preparing the charge transporting layer of the invention is desirable because of a reduced equipment cost and savings in labor.

The a-C layer of the present invention may be used also as an overcoat layer having charge transporting properties. The present a-C layer, even when used merely as an overcoat layer, affords high durability without resulting a higher residual potential.

The photosensitive member of the present invention comprises a charge generating layer and a charge transporting layer of the type described above, which are formed in a superposed structure suitably determined as required.

Figure 2:
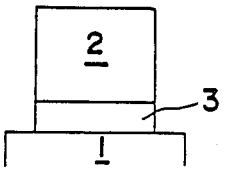
Figure 3:
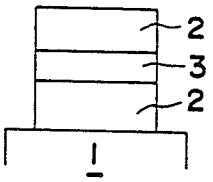

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1, the holes then generated in the charge generating layer 3 travel through the charge transport layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may be replaced by each other in respect of the above behavior for the interpretation of the travel of carriers. With the structures of FIGS. 2 and 3, the image projecting light passes through the charge transporting layer, which nevertheless has high transmittancy, permitting satisfactory formation of latent images.

Figure 4:
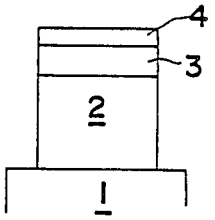

FIG. 4 shows another type comprising an electrically conductive substrate 1, and a charge transporting layer 2, a charge generating layer 3 and a surface protective layer 4 provided over the substrate and arranged one over another. Thus, the illustrated structure corresponds to the structure of FIG. 1 provided with a surface protective layer. Since the outermost surface of the structure of FIG. 1 is provided by a charge generating layer which is not limited specifically in the present invention, it is generally desirable that the surface be covered with a protective layer for assuring durability for use. With the structures of FIGS. 2 and 3, the charge transporting layer embodying the invention and having high durability provides the outermost surface, so that the surface protective layer need not be provided. However, such a photosensitive member can be formed with a surface protective layer as another type so as to be compatible with various other elements within the copying machine, for example, to be free from surface soiling deposition of developer.

Figure 5:
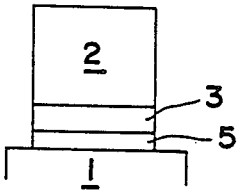

FIG. 5 shows another type comprising an electrically conductive substrate 1, and an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer which is not limited specifically in the invention is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention which is excellent in adhesion and injection inhibitory effect is joined to the substrate, so that no intermediate layer may be provided. However, the photosensitive member of either of these types can be formed with an intermediate layer in order to render the transporting layer to be formed compatible with the preceding fabrication step, such as pretreatment of the conductive substrate. Another type of photosensitive member is then available.

Figure 6:
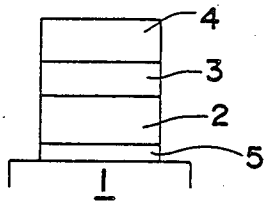

FIG. 6 shows still another type comprising an electrically conductive substrate 1, and an intermediate layer 5, a charge transporting layer 2, a charge generating layer 3 and a surface protective layer 4 which are formed over the substrate and superposed one over another. Thus, this structure corresponds to the structure of FIG. 1 provided with an intermediate layer and a surface protective layer. The intermediate and protective layers are formed for the same reasons as already stated. Thus, the provision of these two layers in the structure of FIG. 2 or 3 affords another type.

According to the present invention, the intermediate layer and the surface protective layer are not limited specifically in material or fabrication process. Any material or process is suitably selectable provided that tne contemplated object can be achieved. The a-C layer of the invention may be used. However, if the material to be used is an insulating material such as one already mentioned, the thickness of the layer needs to be up to 5.μm to preclude occurrence of residual potential.

The charge transporting layer of the photosensitive member embodying the present invention is produced by so-called plasma polymerization wherein molecules in a vapor phase are subjected to discharge decomposition in a vacuum phase, and the active neutral seeds or charge seeds contained in the resulting atmosphere of plasma are led onto a substrate by diffusion or an electric or magnetic force and accumulated into a solid phase on the substrate through a rebinding reaction.

Figure 7:
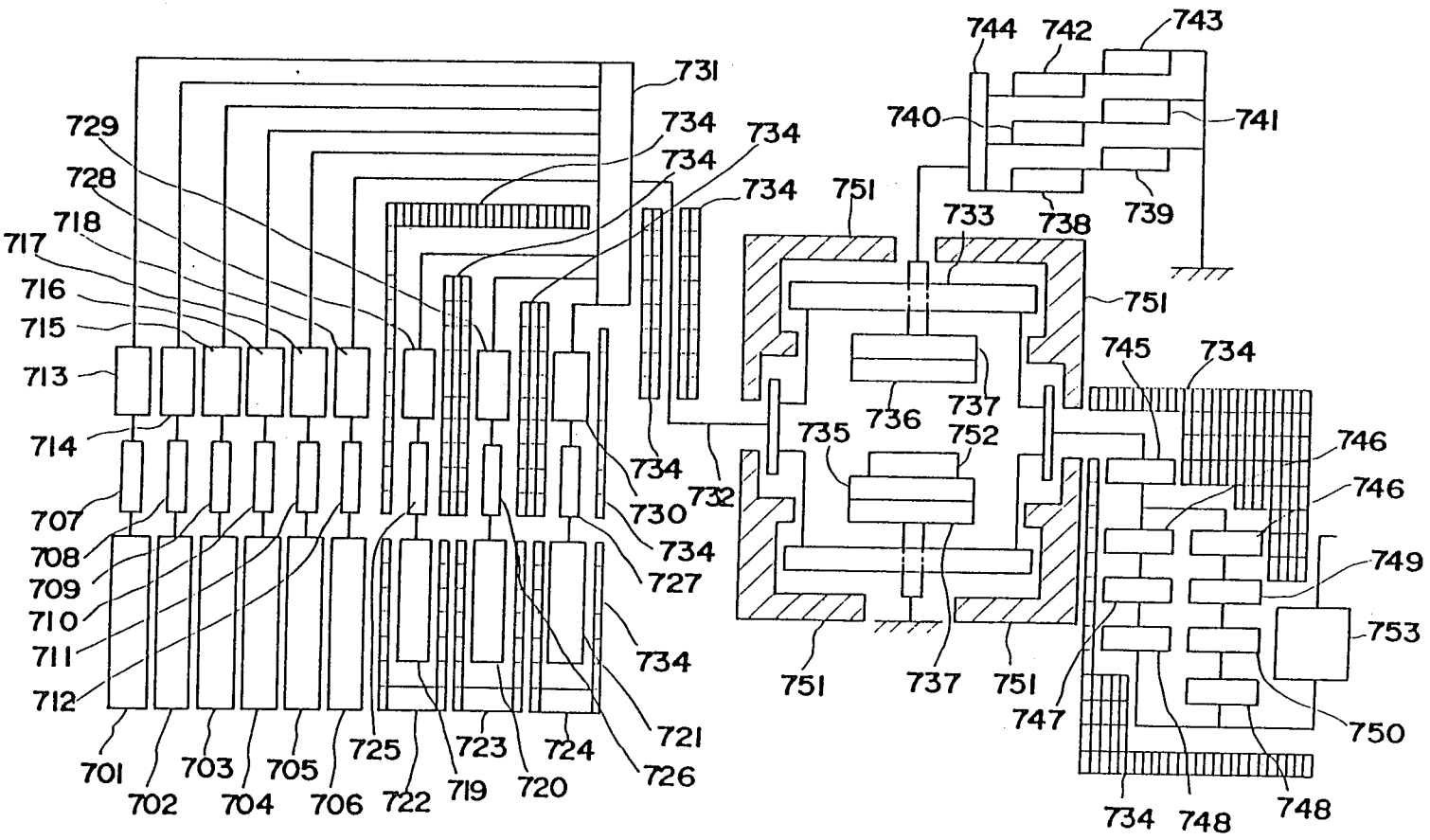
FIGS. 7 and 8 are diagrams showing apparatus for preparing photosensitive members according to the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among thes gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting valve 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
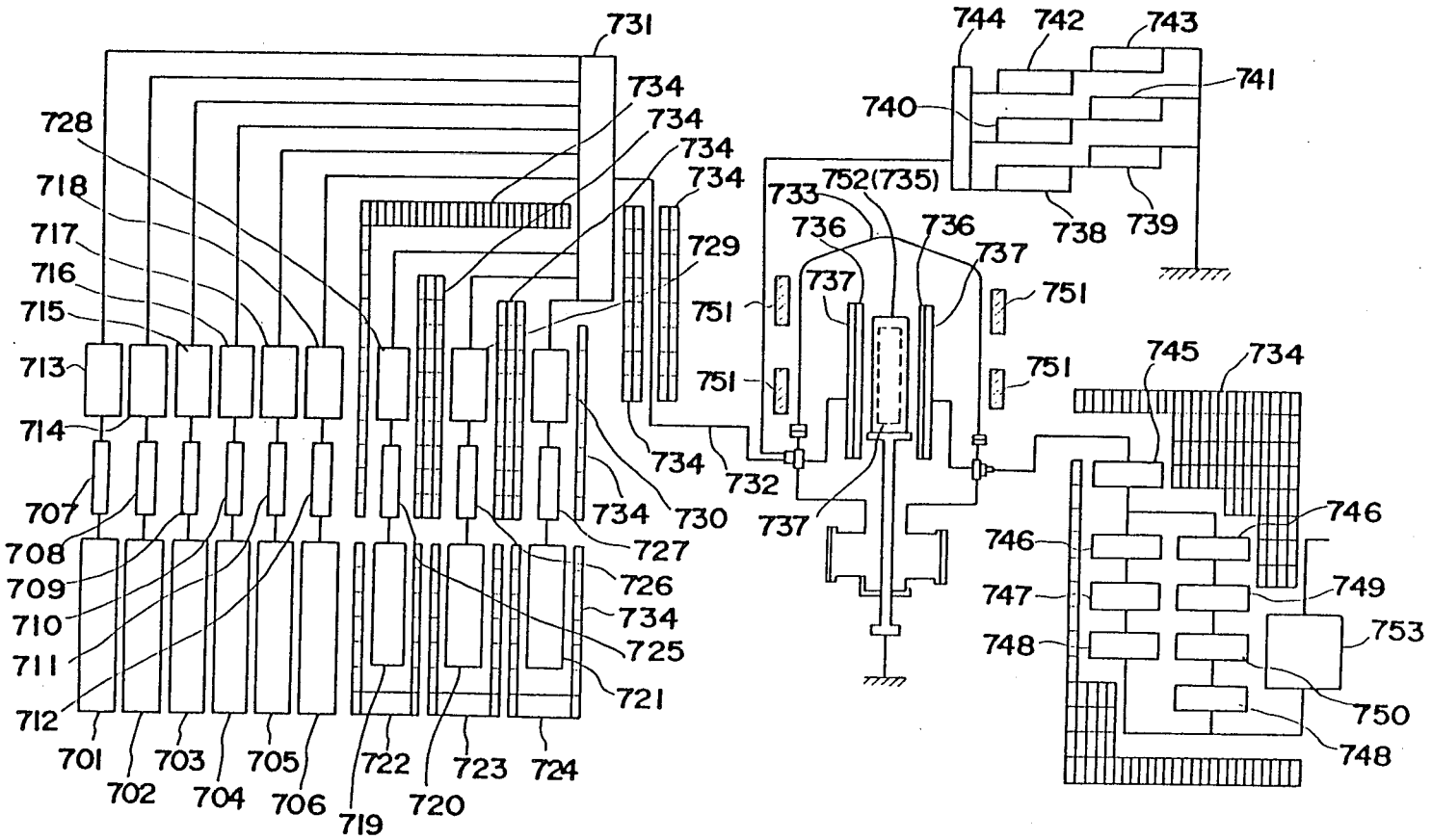

FIG. 8 shows another type of apparatus for preparing the photosensitive member of the invention. This apparatus has the same construction as the apparatus of FIG. 7 with the exception of the interior arrangement of the reactor 733. With reference to FIG. 8, the reactor 733 is internally provided with a hollow cylindrical electrically conductive substrate 752 serving also as the grounded electrode 735 of FIG. 7 and with an electrode heater 737 inside thereof. A power application electrode 736, similarly in the form of a hollow cylinder, is provided around the substrate 752 and surrounded by an electrode heater 737. The conductive substrate 752 is rotatable about its own axis by a drive motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. To obtain a photosensitive member of the desired one of the foregoing structures, an undercoat layer or a charge generating layer may be formed on the substrate before the charge transporting layer is formed when so required. The undercoat or charge generating layer may be formed by the present apparatus or by some other apparatus. Subsequently, material gases, i.e. suitably selected hydrocarbon, oxygen compounds and nitrogen compounds, are fed into the reactor from the first to sixth tanks and the first to third containers (i.e. from those concerned), each at a specified flow rate, using the flow controllers concerned, and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. The low-frequency power supply, 10 KHz to 1 MHz in frequency, may alternatively be selected. This initiates discharge across the two electrodes, forming a solid layer on the substrate with time. The thickness of the layer is controllable by varying the reaction time, such that the discharge is discontinued upon the thickness reaching the desired value.

Consequently, an a-C layer of the invention is obtained which serves as a charge transporting layer.

The a-C layer comprising hydrogen and carbon is characterized in that it contains 0.1 to 67 atomic % of hydrogen atoms based on the combined amount of hydrogen and carbon atoms in the layer and 0.1 to 5.0 atomic % of nitrogen atoms and/or 0.1 to 7.0 atomic % of oxygen atoms based on all the constituent atoms in the layer.

Next, the regulator valves concerned are closed, and the reactor is thoroughly exhausted. When a photosensitive member of the desired structure has been formed according to the invention, the vacuum within the reactor is vitiated, and the member is removed from the reactor. If a charge generating layer or overcoat layer needs to be further formed to obtain the desired photosensitive structure, the layer is formed using the present apparatus as it is, or using another apparatus to which the product is transferred from the present apparatus after similarly breaking the vacuum, whereby the desired photosensitive member is obtained according to the invention.

The present invention will be described with reference to the following examples.

EXAMPLE 1

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, ethylene gas from the second tank 702 into the second flow controller 714 and nitrogen gas from the third tank 703 into the third flow controller 715, each at an output pressure of 1.0 kg/cm$^2$. The dials on the flow controllers were adjusted to supply the hydrogen gas at a flow rate of 40 sccm, the ethylene gas at 30 sccm and the nitrogen gas at 15 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in legth, 50 mm in width and 3 mm in thickness, was preheated to 250° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 7 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 52 atomic % of hydrogen atoms based on the combined amount of carbon atoms and hydrogen atoms and 1.2 atomic % of nitrogen atoms based on all the constituent atoms therein.

Charge Generating Layer Forming Step (CGL)

Next, the first, fifth and sixth regulator valves 707, 711 and 712 were opened to introduce hydrogen gas from the first tank 701 into the first flow controller 713, nitrous oxide gas from the fifth tank 705 into the fifth flow controller 717 and silane gas from the sixth tank 706 into the sixth flow controller 718, each at an output pressure of 1.0 kg/cm$^2$. The dials on the flow controllers were adjusted to supply the hydrogen gas at a flow rate of 210 sccm, nitrous oxide gas at 1.0 sccm and the silane gas at 90 sccm to the reactor 733. After the flows of the gases stabilized, the internal pressure of the reactor 733 was adjusted to 0.8 torr by the pressure control valve 745. On the other hand, the substrate 752 formed with the a-C layer was preheated to 250° C. With the gas flow rates and the pressure in stabilized state, 35-watt power with a frequency of 13.56 MHz was applied to the power application electrode 736 from the high-frequency power source 739 to effect glow discharge for 5 minutes, whereby a charge generating a-Si:H layer was formed with a thickness of 0.3 microns.

Characteristics

When the photosensitive member obtained was used for the usual Carlson process, the member showed a maximum charge potential (hereinafter referred to as Vmax) of −600 V. Specifically, the chargeability per 1 micron (hereinafter referred to as C.A.) was 82 V by calculating from the entire thickness of the member, i.e. 7.3 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 7.1 lux-sec. This revealed that the member was satisfactory in photosensitive characteristics. The amount of light required for the light decay as described above was about 7.5 lux-sec. after three months upon the formation of the present photosensitive member. This showed that the member had stabilized characteristics over a prolonged priod of time free of deterioration despite lapse of time.

Further, the photosensitive member was 2.3 in optical energy gap (Egopt) and 3.3 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 2

The photosensitive member was prepared by exactly the same process as in Example 1 except that the flow rate of nitrogen gas was set to 30 sccm.

When subjeted to CHN quantitative analysis, the a-C layer thus obtained was found to contain 54 atomic % of hydrogen atoms based on the combined amount of carbon atoms and hydrogen atoms and 2.1 atomic % of nitrogen atoms based on all the constituent atoms therein. Moreover, the thickness of the a-C layer was 7.9 microns.

Characteristics

When the photosensitive member obtained was used for the usual Carlson process, the member showed a Vmax of −630 V. Specifically, the C.A. was 77 V by calculating from the entire thickness of the member, i.e. 8.2 microns, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 8.3 lux-sec. This revealed that the member was satisfactory in photosensitive characteristics. The amount of light required for the light decay as described above was about 8.5 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.3 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 3

The photosensitive member was prepared by exactly the same process as in Example 1 except that the flow rate of nitrogen gas was set to 60 sccm.

When subjeted to CHN quantitative analysis, the a-C layer thus obtained was found to contain 53 atomic % of hydrogen atoms based on the combined amount of carbon atoms and hydrogen atoms and 2.8 atomic % of nitrogen atoms based on all the constituent atoms therein. Moreover, the thickness of the a-C layer was 8.3 microns.

Characteristics

When the photosensitive member obtained was used for the usual Carlson process, the member showed a Vmax of −600 V. Specifically, the C.A. was 70 V by calculating from the entire thickness of the member, i.e. 8.6 microns, indicating that the member had satisfactory charging properties.

The period of time required for dark decay from −600 V to −550 V was about 25 seconds, showing that the member had satisfactory charge retentivity.

When the member was initially charged to −500 V and thereafter exposed to white light to decay the charge to −100 V, the amount of light required for the light decay was about 9.2 lux-sec. This revealed that the member was satisfactory in photosensitive characteristics. The amount of light required for the light decay as described above was about 10.0 lux-sec. after three months upon the formation of the present photosensitive member. This showed that the member had stabilized characteristics over a prolonged priod of time free of deterioration despite lapse of time.

Further, the photosensitive member was 3.0 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 4

The photosensitive member was prepared by exactly the same process as in Example 1 except that the flow rate of nitrogen gas was set to 120 sccm.

When subjeted to CHN quantitative analysis, the a-C layer thus obtained was found to contain 52 atomic % of hydrogen atoms based on the combined amount of carbon atoms and hydrogen atoms and 3.9 atomic % of nitrogen atoms based on all the constituent atoms therein. Moreover, the thickness of the a-C layer was 9.2 microns.

Characteristics

When the photosensitive member obtained was used for the usual Carlson process, the member showed a Vmax of −500 V. Specifically, the C.A. was 53 V by calculating from the entire thickness of the member, i.e. 9.5 microns, indicating that the member had satisfactory charging properties.

The period of time required for dark decay from −500 V to −450 V was about 20 seconds, showing that the member had satisfactory charge retentivity.

When the member was initially charged to −500 V and thereafter exposed to white light to decay the charge to −100 V, the amount of light required for the light decay was about 20.0 lux-sec. This revealed that the member was satisfactory in photosensitive characteristics. The amount of light required for the light decay as described above was about 19.8 lux-sec. after three months upon the formation of the present photosensitive member. This showed that the member had stabilized characteristics over a prolonged priod of time free of deterioration despite lapse of time.

Further, the photosensitive member was 3.2 in optical energy gap (Egopt) and 2.8 in relative dielectric constant.

These results indicate that the photosensitive member prepared in the present example according to the invention exhibits outstanding performance, although the present member is slightly lower in electrostatic characteristics than those in Examples 1 to 3. When the member was used in the Carlson process for forming images thereon, followed by image transfer, sharp copy images were obtained.

COMPARATIVE EXAMPLE 1

The photosensitive member was prepared by exactly the same process as in Example 1 except that nitrogen gas was not introduced in CTL step.

When subjeted to CHN quantitative analysis, the a-C layer thus obtained was found to contain 55 atomic % of hydrogen atoms based on the combined amount of carbon atoms and hydrogen atoms. However, the nitrogen atoms was not found in the a-C layer. Moreover, the thickness of the a-C layer as 4.9 microns, showing that the film-forming speed was lower than those of Examples 1 to 4.

Characteristics

When the photosensitive member obtained was used for the usual Carlson process, the member showed a Vmax of −500 V. Specifically, the C.A. of the member was 96 V by calculating from the entire thickness of the member, i.e. 5.2 microns, indicating that the member had satisfactory charging properties.

The period of time required for dark decay from −500 V to −450 V was about 15 seconds, showing that the member had satisfactory charge retentivity.

However, when the member was initially charged to −500 V and thereafter exposed to white light to decay the charge to −100 V, the amount of light required for the light decay was about 7.3 lux-sec. On the other hand, the member did not attain a half-reduced value with the light exposure of about 50 lux-sec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of nitrogen.

COMPARATIVE EXAMPLE 2

The photosensitive member was prepared by exactly the same process as in Example 1 except that the flow rate of nitrogen gas was set to 200 sccm in CTL step.

The a-C layer thus obtained was poor in ability for film-forming and was partly separated from the substrate.

When subjeted to CHN quantitative analysis, the a-C layer thus obtained was found to contain 54 atomic % of hydrogen atoms based on the combined amount of carbon atoms and hydrogen atoms and 5.5 atomic % of nitrogen atoms based on all the constituent atoms therein. Moreover, the thickness of the a-C layer was 10.3 microns.

Characteristics

When the photosensitive member obtained was used for the usual Carlson process, the member showed a Vmax of −150 V. Specifically, the C.A. of the member was 14 V by calculating from the entire thickness of the member, i.e. 10.6 microns, indicating that the member was poor in charging properties.

When the member was initially charged to −150 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of nitrogen.

EXAMPLE 5

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and third regulator valves 707 and 709 were thereafter opened to introduce hydrogen gas from the first tank 701 into the first flow controller 713 and ammonia gas from the third tank 703 into the third flow controller 715, each at an output pressure of 1.0 kg/cm$^2$. At the same time, the seventh regulator valve 725 and was opened and styrene, heated at a temperature of 50° C. by the first heater 722 was introduced into the seventh flow controller 728 from the first container 719. The dials on the flow controllers were adjusted to supply the hydrogen gas at a flow rate of 40 sccm, the ammonia gas at a flow rate of 10 sccm and the styrene gas at 20 sccm to the reactor 733 through the main pipe 732 via the intermediate mixer 731. After the flows of the gases were stabilized, the internal pressure of the reactor 733 was adjusted to 0.7 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 200-watt power with a frequency of 50 KHz was applied to the power application electrode 736 from the low-frequency power source 741 preconnected thereto by the selecting switch 744 to conduct plasma polymerization for 1 hour, forming an a-C layer, 20.7 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 37 atomic % of hydrogen atoms based on the combined amount of carbon atoms and hydrogen atoms and 1.3 atomic % of nitrogen atoms based on all the constituent atoms therein.

CGL (a-Si) Step

The a-Si:H charge generating layer having a thickness of 0.3 microns was subsequently formed by the same manner as in Example 1.

Characteristics

When the photosensitive member obtained was used for the usual Carlson process, the member showed a Vmax of −1000 V, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 9.5 lux-sec. This revealed that the member was satisfactory in photosensitive characteristics. The amount of light required for the light decay as described above was about 9.5 lux-sec. after three months upon the formation of the present photosensitive member. This showed that the member had stabilized characteristics over a prolonged priod of time free of deterioration despite lapse of time.

Further, the photosensitive member was 2.3 in optical energy gap (Egopt) and 3.4 in relative dielectric constant.

These results indicate that the photosensitive member prepared in the present example according to the invention exhibits outstanding performance, although the present member is slightly lower in electrostatic characteristics than those in Examples 1 to 3. When the member was used in the Carlson process for forming images thereon, followed by image transfer, sharp copy images were obtained.

EXAMPLE 6

The photosensitive member was prepared by the same manner as in Example 5 except that the flow rate of ammonia gas was set to 20 sccm in CTL step.

When subjeted to CHN quantitative analysis, the a-C layer thus obtained was found to contain 41 atomic % of hydrogen atoms based on the combined amount of carbon atoms and hydrogen atoms and 2.1 atomic % of nitrogen atoms based on all the constituent atoms therein. The thickness of the member was about 21.5 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 10.2 lux-sec. This revealed that the member was satisfactory in photosensitive characteristics. The amount of light required for the light decay as described above was about 10.8 lux-sec. after three months upon the formation of the present photosensitive member. This showed that the member had stabilized characteristics over a prolonged priod of time free of deterioration despite lapse of time.

Further, the photosensitive member was 2.7 in optical energy gap (Egopt) and 3.2 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 7

The photosensitive member was prepared by the same manner as in Example 5 except that the flow rate of ammonia gas was set to 30 sccm in CTL step.

When subjected to CHN quantitative analysis, the a-C layer thus obtained was found to contain 42 atomic % of hydrogen atoms based on the combined amount of carbon atoms and hydrogen atoms and 3.3 atomic % of nitrogen atoms based on all the constituent atoms therein. The thickness of the member was about 23.3 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 12.5 lux-sec. This revealed that the member was satisfactory in photosensitive characteristics. The amount of light required for the light decay as described above was about 12.3 lux-sec. after three months upon the formation of the present photosensitive member. This showed that the member had stabilized characteristics over a prolonged priod of time free of deterioration despite lapse of time.

Further, the photosensitive member was 3.1 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 8

The photosensitive member was prepared by the same manner as in Example 5 except that the flow rate of ammonia gas was set to 60 sccm in CTL step.

When subjeted to CHN quantitative analysis, the a-C layer thus obtained was found to contain 44 atomic % of hydrogen atoms based on the combined amount of carbon atoms and hydrogen atoms and 4.2 atomic % of nitrogen atoms based on all the constituent atoms therein. The thickness of the member was about 25.0 microns.

Characteristics

When the photosensitive member obtained was used for the usual Carlson process, the member showed a Vmax of −700 V. Specifically, the C.A. of the member was about 28 V by calculating from the entire thickness of the member, i.e., 25.3 microns, indicating that the member had satisfactory charging properties.

The period of time required for dark decay from −600 V to −550 V was about 25 seconds, showing that the member had satisfactory charge retentivity.

When the member was initially charged to −500 V and thereafter exposed to white light to decay the charge to −100 V, the amount of light required for the light decay was about 19.5 lux-sec. This revealed that the member was satisfactory in photosensitive characteristics. The amount of light required for the light decay as described above was about 20.5 lux-sec. after three months upon the formation of the present photosensitive member. This showed that the member had stabilized characteristics over a prolonged priod of time free of deterioration despite lapse of time.

Further, the photosensitive member was 3.5 in optical energy gap (Egopt) and 2.7 in relative dielectric constant.

These results indicate that the photosensitive member prepared in the present example according to the invention exhibits outstanding performance, although the member was slightly lower in electrostatic characteristics than those of Examples 5 to 7. When the member was used in the Carlson process for forming images thereon, followed by image transfer, sharp copy images were obtained.

COMPARATIVE EXAMPLE 3

The photosensitive member was prepared by exactly the same process as in Example 5 except that ammonia gas was not introduced in CTL step.

When subjeted to CHN quantitative analysis, the a-C layer thus obtained was found to contain 43 atomic % of hydrogen atoms based on the combined amount of carbon atoms and hydrogen atoms. However, the nitrogen atoms was not found in the a-C layer. Moreover, the thickness of the a-C layer was 15.3 microns, showing that the film-forming speed was lower than those of Examples 5 to 8.

Characteristics

When the photosensitive member obtained was used for the usual Carlson process, the member showed a Vmax of −1000 V, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 7.2 lux-sec. On the other hand, the member did not attain a half-reduced value with the light exposure of about 50 luxsec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of nitrogen.

COMPARATIVE EXAMPLE 4

The photosensitive member was prepared by exactly the same process as in Example 5 except that the flow rate of nitrogen gas was set to 120 sccm in CTL step.

The a-C layer thus obtained was poor in ability for film-forming and was somewhat oily.

When subjeted to CHN quantitative analysis, the a-C layer thus obtained was found to contain 39 atomic % of hydrogen atoms based on the combined amount of carbon atoms and hydrogen atoms and 6.3 atomic % of nitrogen atoms based on all the constituent atoms therein. Moreover, the thickness of the a-C layer was 27.5 microns.

Characteristics

When the photosensitive member obtained was used for the usual Carlson process, the member showed a Vmax of −350 V. Specifically, the C.A. of the member was 13 V by calculating from the entire thickness of the member, i.e. 27.8 microns, indicating that the member was poor in charging properties.

When the member was initially charged to −350 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of nitrogen.

EXAMPLE 9

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and propylene gas from the second tank 702 into the second flow controller 714, each at an output pressure of 1.0 kg/cm$^2$. At the same time, the seventh and eighth regulator valves 725 and 726 were opened, and styrene gas, heated at a temperature of 70° C. by the first heater 722 and anniline gas, heated at a temperature of 130° C. by the second heater 723 were introduced into the seventh and eighth flow controllers 728 and 729 from the first and second containers 719 and 720. The dials on the flow controllers were adjusted to supply the hydrogen gas at a flow rate of 200 sccm, the propylene gas at 150 sccm, the styrene gas at 50 sccm and the anniline gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 350 mm, was preheated to 200° C. With the gas flow rates and the pressure in stabilized state, 250-watt power with a frequency of 13.56 MHz was applied to the power application electrode 736 from the high-frequency power source 739 which was connected to the electrode by the connection selecting switch 744 in advance to conduct plasma polymerization for 2 hours, foming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 47 atomic % of hydrogen atoms based on the combined amount of carbon atoms and hydrogen atoms and 0.5 atomic % of nitrogen atoms based on all the constituent atoms therein.

Charge Generating Layer Forming Step (CGL)

Next, the first, fourth, fifth and sixth regulator valves 707, 710, 711 and 712 were opened to introduce hydrogen gas from the first tank 701 into the first flow controller 713, nitrous oxide gas from the fourth tank 704 into the fourth flow controller 716, diborane gas which was diluted to the concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm, the nitrous oxide gas at 1.0 sccm, the diborane gas diluted to the concentration of 50 ppm with hydrogen gas at a flow rate of 10 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 250° C. With the gas flow rates and the pressure in stabilized state, 200-watt power with a frequency of 13.56 MHz was applied to the power application electrode 736 from the high-frequency power source 739 to effect glow discharge for 5 minutes, whereby a charge generating a-Si:B:H layer was formed with a thickness of 0.3 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 8.2 lux-sec. This revealed that the member was satisfactory in photosensitive characteristics. The amount of light required for the light decay as described above was about 8.7 lux-sec. after three months upon the formation of the present photosensitive member. This showed that the member had stabilized characteristics over a prolonged priod of time free of deterioration despite lapse of time.

Further, the photosensitive member was 2.4 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 10

The photosensitive member was prepared by the same manner as in Example 9 except that the flow rate of anniline gas was set to 10 sccm in CTL step.

When subjeted to CHN quantitative analysis, the a-C layer thus obtained was found to contain 42 atomic % of hydrogen atoms based on the combined amount of carbon atoms and hydrogen atoms and 1.8 atomic % of nitrogen atoms based on all the constituent atoms therein. The thickness of the member was about 21.5 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 15 seconds, showing that the member had satisfactory charge retentivity.

When the member was initially charged to +500 V and thereafter exposed to white light to decay the charge to +100 V, the amount of light required for the light decay was about 8.0 lux-sec. This revealed that the member was satisfactory in photosensitive characteristics. The amount of light required for the light decay as described above was about 9.1 lux-sec. after three months upon the formation of the present photosensitive member. This showed that the member had stabilized characteristics over a prolonged priod of time free of deterioration despite lapse of time.

Further, the photosensitive member was 3.1 in optical energy gap (Egopt) and 3.3 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 11

The photosensitive member was prepared by the same manner as in Example 9 except that the flow rate of anniline gas was set to 15 sccm in CTL step.

When subjected to CHN quantitative analysis, the a-C layer thus obtained was found to contain 47 atomic % of hydrogen atoms based on the combined amount of carbon atoms and hydrogen atoms and 3.5 atomic % of nitrogen atoms based on all the constituent atoms therein. The thickness of the member was about 24.8 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 11.6 lux-sec. This revealed that the member was satisfactory in photosensitive characteristics. The amount of light required for the light decay as described above was about 12.0 lux-sec. after three months upon the formation of the present photosensitive member. This showed that the member had stabilized characteristics over a prolonged priod of time free of deterioration despite lapse of time.

Further, the photosensitive member was 3.1 in optical energy gap (Egopt) and 3.0 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 12

The photosensitive member was prepared by the same manner as in Example 9 except that the flow rate of anniline gas was set to 30 sccm and the temperature of the second heater 723 was set to 150° C. in CTL step.

When subjeted to CHN qu antitative analysis, the a-C layer thus obtained was found to contain 46 atomic % of hydrogen atoms based on the combined amount of carbon atoms and hydrogen atoms and 5.0 atomic % of nitrogen atoms based on all the constituent atoms therein. The thickness of the member was about 25.0 microns.

Characteristics

When the photosensitive member obtained was used for the usual Carlson process, the member showed a Vmax of +700 V. Specifically, the C.A. of the member was about 28 V by calculating from the entire thickness, i.e., 25.3 microns, indicating that the member had satisfactory charging properties.

The period of time required for dark decay from +600 V to +550 V was about 25 seconds, showing that the member had satisfactory charge retentivity.

When the member was initially charged to +500 V and thereafter exposed to white light to decay the charge to +100 V, the amount of light required for the light decay was about 20.2 lux-sec. This revealed that the member was satisfactory in photosensitive characteristics. The amount of light required for the light decay as described above was about 21.8 lux-sec. after three months upon the formation of the present photosensitive member. This showed that the member had stabilized characteristics over a prolonged priod of time free of deterioration despite lapse of time.

Further, the photosensitive member was 3.3 in optical energy gap (Egopt) and 2.8 in relative dielectric constant.

These results indicate that the photosensitive member prepared in the present example according to the invention exhibits outstanding performance, although the member of the present example was slightly lower in electrostatic characteristics than those of Examples 9 to 11. When the member was used in the Carlson process for forming images thereon, followed by image transfer, sharp copy images were obtained.

COMPARATIVE EXAMPLE 5

The photosensitive member was prepared by exactly the same process as in Example 9 except that anniline gas was not introduced in CTL step.

When subjected to CHN quantitative analysis, the a-C layer thus obtained was found to contain 48 atomic % of hydrogen atoms based on the combined amount of carbon atoms and hydrogen atoms. However, the nitrogen atoms was not found in the a-C layer. Moreover, the thickness of the a-C layer was 19.5 microns, showing that the film-forming speed was lower than those of Examples 9 to 11.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 7.2 lux-sec. On the other hand, the member did not attain a half-reduced value with the light exposure of about 50 lux-sec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of nitrogen.

COMPARATIVE EXAMPLE 6

The photosensitive member was prepared by exactly the same process as in Example 9 except that the flow rate of nitrogen gas was set to 60 sccm and the temperature of the second heater was set to 165° C. in CTL step.

The a-C layer thus obtained was poor in ability for film-forming and the substrate was coated with oily material, forming no charge transporting layer in a solid state.

When subjeted to CHN quantitative analysis, the oily a-C layer thus obtained was found to contain 45 atomic % of hydrogen atoms based on the combined amount of carbon atoms and hydrogen atoms and 8.0 atomic % of nitrogen atoms based on all the constituent atoms therein.

As apparent from the above, the amount of nitrogen contained in the a-C layer of the present invention is important in view of the film formation.

EXAMPLE 13

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first second and third regulator valves 707, 708 and 709 were thereafter opened to introduce hydrogen gas from the first tank 701 into the first flow controller 713, ethylene gas from the second tank 702 into the second flow controller 714 and oxygen gas from the third tank 703 into the third flow controller 715, each at an output pressure of 1.0 kg/cm$^2$. The dials on the flow controllers were adjusted to supply the hydrogen gas at a flow rate of 80 sccm, the ethylene gas at 60 sccm and the oxygen gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 250° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 5 hours, forming an a-C layer, 10 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 55 atomic % of hydrogen atoms based on the combined amount of carbon atoms and hydrogen atoms and 1.7 atomic % of oxygen atoms based on all the constituent atoms therein.

Charge Generating Layer Forming Step (CGL)

The a-Si:H charge generating layer having a thickness of about 0.3 microns was formed by the same process as in Example 1.

Characteristics

When the photosensitive member obtained was used for the usual Carlson process, the member showed a Vmax of −700 V. Specifically, the C.A. was 68 V by calculating from the entire thickness of the member, i.e. 10.3 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 3.2 lux-sec. This revealed that the member was satisfactory in photosensitive characteristics. The amount of light required for the light decay as described above was about 3.3 lux-sec. after three months upon the formation of the present photosensitive member. This showed that the member had stabilized characteristics over a prolonged period of time free of deterioration despite lapse of time.

Further, the photosensitive member was 2.2 in optical energy gap (Egopt) and 3.4 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 14

The photosensitive member was prepared by exactly the same process as in Example 13 except that the flow rate of oxygen gas was set to 10 sccm.

When subjeted to CHN quantitative analysis, the a-C layer thus obtained was found to contain 49 atomic % of hydrogen atoms based on the combined amount of carbon atoms and hydrogen atoms and 3.8 atomic % of oxygen atoms based on all the constituent atoms therein. Moreover, the thickness of the a-C layer was 9.7 microns.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 0.67.

Characteristics

When the photosensitive member obtained was used for the usual Carlson process, the member showed a Vmax of −640 V. Specifically, the C.A. was 64 V by calculating from the entire thickness of the member, i.e. 10 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 3.5 lux-sec. This revealed that the member was satisfactory in photosensitive characteristics. The amount of light required for the light decay as described above was about 3.5 lux-sec. after three months upon the formation of the present photosensitive member. This showed that the member had stabilized characteristics over a prolonged priod of time free of deterioration despite lapse of time.

Further, the photosensitive member was 2.3 in optical energy gap (Egopt) and 3.2 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 15

The photosensitive member was prepared by exactly the same process as in Example 13 except that the flow rate of oxygen gas was set to 15 sccm.

When subjected to CHN quantitative analysis, the a-C layer thus obtained was found to contain 50 atomic % of hydrogen atoms based on the combined amount of carbon atoms and hydrogen atoms and 4.7 atomic % of oxygen atoms based on all the constituent atoms therein. Moreover, the thickness of the a-C layer was 9.2 microns.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 0.8.

Characteristics

When the photosensitive member obtained was used for the usual Carlson process, the member showed a Vmax of −600 V. Specifically, the C.A. was 63 V by calculating from the entire thickness of the member, i.e. 9.5 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 5.3 lux-sec. This revealed that the member was satisfactory in photosensitive characteristics. The amount of light required for the light decay as described above was about 5.7 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.0 in relative dielectric constant. These results indicate that the photosensitive member prepared in the present example according to the invention exhibits outstanding performance. When the member was used in the Carlson process for forming images thereon, followed by image transfer, sharp copy images were obtained.

EXAMPLE 16

The photosensitive member was prepared by exactly the same process as in Example 13 except that the flow rate of oxygen gas was set to 30 sccm.

When subjeted to CHN quantitative analysis, the a-C layer thus obtained was found to contain 45 atomic % of hydrogen atoms based on the combined amount of carbon atoms and hydrogen atoms and 7.0 atomic % of oxygen atoms based on all the constituent atoms therein. Moreover, the thickness of the a-C layer was 7.7 microns.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 1.0.

Characteristics

When the photosensitive member obtained was used for the usual Carlson process, the member showed a Vmax of −500 V. Specifically, the C.A. was 63 V by calculating from the entire thickness of the member, i.e. 8.0 microns, indicating that the member had satisfactory charging properties.

The period of time required for dark decay from −500 V to −450 V was about 20 seconds, showing that the member had satisfactory charge retentivity.

When the member was initially charged to −500 V and thereafter exposed to white light to decay the charge to −100 V, the amount of light required for the light decay was about 8.7 lux-sec. This revealed that the member was satisfactory in photosensitive characteristics. The amount of light required for the light decay as described above was about 9.1 lux-sec. after three months upon the formation of the present photosensitive member. This showed that the member had stabilized characteristics over a prolonged period of time free of deterioration despite lapse of time.

Further, the photosensitive member was 3.0 in optical energy gap (Egopt) and 2.9 in relative dielectric constant.

These results indicate that the photosensitive member prepared in the present example according to the invention exhibits outstanding performance, although the present member is slightly lower in electrostatic characteristics than those in Examples 13 to 15. When the member was used in the Carlson process for forming images thereon, followed by image transfer, sharp copy images were obtained.

COMPARATIVE EXAMPLE 7

The photosensitive member was prepared by exactly the same process as in Example 13 except that oxygen gas was not introduced in CTL step.

When subjeted to CHN quantitative analysis, the a-C layer thus obtained was found to contain 53 atomic % of hydrogen atoms based on the combined amount of carbon atoms and hydrogen atoms. However, the oxygen atoms was not found in the a-C layer. Moreover, the thickness of the a-C layer was 10.4 microns.

Characteristics

When the photosensitive member obtained was used for the usual Carlson process, the member showed a Vmax of −750 V. Specifically, the C.A. of the member was 70 V by calculating from the entire thickness of the member, i.e. 10.7 microns, indicating that the member had satisfactory charging properties.

The period of time required for dark decay from −500 V to −450 V was about 15 seconds, showing that the member had satisfactory charge retentivity.

However, when the member was initially charged to −500 V and thereafter exposed to white light to decay the charge to −100 V, the amount of light required for the light decay was about 3.1 lux-sec. On the other hand, the member did not attain a half-reduced value with the light exposure of about 50 lux-sec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of oxygen.

COMPARATIVE EXAMPLE 8

The photosensitive member was prepared by exactly the same process as in Example 13 except that the flow rate of oxygen gas was set to 60 sccm in CTL step.

The a-C layer thus obtained was poor in ability for film-forming due to the excess amount of oxygen, specifically, the thickness of the layer was 5.4 microns after the formation of 10 hours.

When subjeted to CHN quantitative analysis, the a-C layer thus obtained was found to contain 42 atomic % of hydrogen atoms based on the combined amount of carbon atoms and hydrogen atoms and 8.2 atomic % of oxygen atoms based on all the constituent atoms therein.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 1.7.

Characteristics

When the photosensitive member obtained was used for the usual Carlson process, the member showed a Vmax of −250 V, indicating that the member was poor in charging properties.

When the member was initially charged to −250 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of oxygen.

EXAMPLE 17

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and third regulator valves 707 and 709 were thereafter opened to introduce hydrogen gas from the first tank 701 into the first flow controller 713 and carbon dioxide gas from the third tank 703 into the third flow controller 715, each at an output pressure of 1.0 $kg/cm^2$. At the same time, the seventh regulator valve 725 was opened and styrene, heated at a temperature of 50° C. by the first heater 722 was introduced into the seventh flow controller 728 from the first container 719. The dials on the flow controllers were adjusted to supply the hydrogen gas at a flow rate of 40 sccm, the carbon dioxide gas at a flow rate of 7 sccm and the styrene gas at 28 sccm to the reactor 733 through the main pipe 732 via the intermediate mixer 731. After the flows of the gases were stabilized, the internal pressure of the reactor 733 was adjusted to 0.7 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 200-watt power with a frequency of 50 KHz was applied to the power application electrode 736 from the low-frequency power source 741 preconnected thereto by the selecting switch 744 to conduct plasma polymerization for 1 hour, forming an a-C layer, 18 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 37 atomic % of hydrogen atoms based on the combined amount of carbon atoms and hydrogen atoms and 1.1 atomic % of oxygen atoms based on all the constituent atoms therein.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 0.52.

CGL (a-Si) Step

The a-Si:H charge generating layer having a thickness of 0.3 microns was subsequently formed by the same manner as in Example 1.

Characteristics

When the photosensitive member obtained was used for the usual Carlson process, the member showed a Vmax of −1000 V, indicating that the member had satisfactory charging properties.

The period of time required for dark decay from −600 V to −550 V was about 25 seconds, showing that the member had satisfactory charge retentivity.

When the member was initially charged to −500V and thereafter exposed to white light to decay the charge to −100V, the amount of light required for the light decay was about 4.3 lux-sec. This revealed that the member was satisfactory in photosensitive characteristics. The amount of light required for the light decay as described above was about 4.6 lux-sec. after three months upon the formation of the present photosensitive member. This showed that the member had stabilized characteristics over a prolonged priod of time free of deterioration despite lapse of time.

Further, the photosensitive member was 2.3 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 18

The photosensitive member was prepared by the same manner as in Example 17 except that the flow rate of carbon dioxide gas was set to 15 sccm in CTL step.

When subjeted to CHN quantitative analysis, the a-C layer thus obtained was found to contain 38 atomic % of hydrogen atoms based on the combined amount of carbon atoms and hydrogen atoms and 2.1 atomic % of oxygen atoms based on all the constituent atoms therein. The thickness of the member was about 17.5 microns.

Characteristics

When the photosensitive member obtained was used for the usual Carlson process, the member showed a Vmax of −1000V, indicating that the member had satisfactory charging properties.

The period of time required for dark decay from −600V to −550V was about 20 seconds, showing that the member had satisfactory charge retentivity.

When the member was initially charged to −500V and thereafter exposed to white light to decay the charge to −100V, the amount of light required for the light decay was about 5.2 lux-sec. This revealed that the member was satisfactory in photosensitive characteristics. The amount of light required for the light decay as described above was about 5.3 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.2 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 19

The photosensitive member was prepared by the same manner as in Example 17 except that the flow rate of carbon dioxide gas was set to 25 sccm in CTL step.

When subjeted to CHN quantitative analysis, the a-C layer thus obtained was found to contain 42 atomic % of hydrogen atoms based on the combined amount of carbon atoms and hydrogen atoms and 3.6 atomic % of oxygen atoms based on all the constituent atoms therein. The thickness of the member was about 16.2 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 5.5 lux-sec. This revealed that the member was satisfactory in photosensitive characteristics. The amount of light required for the light decay as described above was about 5.8 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.1 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 20

The photosensitive member was prepared by the same manner as in Example 17 except that the flow rate of carbon dioxide gas was set to 40 sccm in CTL step.

When subjeted to CHN quantitative analysis, the a-C layer thus obtained was found to contain 40 atomic % of hydrogen atoms based on the combined amount of carbon atoms and hydrogen atoms and 4.9 atomic % of oxygen atoms based on all the constituent atoms therein. The thickness of the member was about 14.0 microns.

Characteristics

When the photosensitive member obtained was used for the usual Carlson process, the member showed a Vmax of −750 V. Specifically, the C.A. of the member was about 52 V by calculating from the entire thickness of the member, i.e., 14.3 microns, indicating that the member had satisfactory charging properties.

The period of time required for dark decay from −600 V to −550 V was about 25 seconds, showing that the member had satisfactory charge retentivity.

When the member was initially charged to −500 V and thereafter exposed to white light to decay the charge to −100 V, the amount of light required for the light decay was about 10.2 lux-sec. This revealed that the member was satisfactory in photosensitive characteristics. The amount of light required for the light decay as described above was about 11.0 lux-sec. after three months upon the formation of the present photosensitive member. This showed that the member had stabilized characteristics over a prolonged priod of time free of deterioration despite lapse of time.

Further, the photosensitive member was 2.8 in optical energy gap (Egopt) and 2.9 in relative dielectric constant.

These results indicate that the photosensitive member prepared in the present example according to the invention exhibits outstanding performance, although the member was slightly lower in electrostatic characteristics than those of Examples 17 to 19. When the member was used in the Carlson process for forming images thereon, followed by image transfer, sharp copy images were obtained.

COMPARATIVE EXAMPLE 9

The photosensitive member was prepared by exactly the same process as in Example 17 except that carbon dioxide gas was not introduced in CTL step.

When subjeted to CHN quantitative analysis, the a-C layer thus obtained was found to contain 42 atomic % of hydrogen atoms based on the combined amount of carbon atoms and hydrogen atoms. However, the nitrogen atoms was not found in the a-C layer. Moreover, the thickness of the a-C layer was 19.5 microns.

Characteristics

When the photosensitive member obtained was used for the usual Carlson process, the member showed a Vmax of −1000 V , indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 4.0 lux-sec. On the other hand, the member did not attain a half-reduced value with the light exposure of about 50 lux-sec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of oxygen.

COMPARATIVE EXAMPLE 10

The photosensitive member was prepared by exactly the same process as in Example 17 except that the flow rate of carbon dioxide gas was set to 100 sccm in CTL step and the film formation was continued for 3 hours.

The a-C layer thus obtained was poor in ability for film-forming, specifically, the thickness of the layer was 14 microns after the formation of 3 hours.

When subjeted to CHN quantitative analysis, the a-C layer thus obtained was found to contain 39 atomic % of hydrogen atoms based on the combined amount of carbon atoms and hydrogen atoms and 7.5 atomic % of oxygen atoms based on all the constituent atoms therein.

Characteristics

When the photosensitive member obtained was used for the usual Carlson process, the member showed a Vmax of −350 V. Specifically, the C.A. of the member was 24 V by calculating from the entire thickness of the member, i.e. 14.3 microns, indicating that the member was poor in charging properties.

When the member was initially charged to −350 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of oxygen.

EXAMPLE 21

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and propylene gas from the second tank 702 into the second flow controller 714, each at an output pressure of 1.0 kg/cm$^2$. At the same time, the seventh and eighth regulator valves 725 and 726 were opened, and styrene gas, heated at a temperature of 70° C. by the first heater 722 and acetone gas, heated at a temperature of 30° C. by the second heater 723 were introduced into the seventh and eighth flow controllers 728 and 729 from the first and second containers 719 and 720. The dials on the flow controllers were adjusted to supply the hydrogen gas at a flow rate of 200 sccm, the propylene gas at 150 sccm, the styrene gas at 50 sccm and the acetone gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 350 mm, was preheated to 200° C. With the gas flow rates and the pressure in stabilized state, 250-watt power with a frequency of 13.56 MHz was applied to the power application electrode 736 from the high-frequency power source 739 which was connected to the electrode by the connection selecting switch 744 in advance to conduct plasma polymerization for 2 hours, forming an a-C layer, 19.5 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 46 atomic % of hydrogen atoms based on the combined amount of carbon atoms and hydrogen atoms and 0.8 atomic % of oxygen atoms based on all the constituent atoms therein.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 0.48.

Charge Generating Layer Forming Step (CGL)

The a-Si:B:H charge generating layer having a thickness of 3 microns was subsequently formed by the same manner as in Example 9.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 6.1 lux-sec. This revealed that the member was satisfactory in photosensitive characteristics. The amount of light required for the light decay as described above was about 6.7 lux-sec. after three months upon the formation of the present photosensitive member. This showed that the member had stabilized characteristics over a prolonged priod of time free of deterioration despite lapse of time.

Further, the photosensitive member was 2.2 in optical energy gap (Egopt) and 3.3 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 22

The photosensitive member was prepared by the same manner as in Example 21 except that the flow rate of acetone gas was set to 10 sccm in CTL step.

When subjeted to CHN quantitative analysis, the a-C layer thus obtained was found to contain 43 atomic % of hydrogen atoms based on the combined amount of carbon atoms and hydrogen atoms and 1.7 atomic % of oxygen atoms based on all the constituent atoms therein. The thickness of the member was about 18.7 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 6.5 lux-sec. This revealed that the member was satisfactory in photosensitive characteristics. The amount of light required for the light decay as described above was about 6.4 lux-sec. after three months upon the formation of the present photosensitive member. This showed that the member had stabilized characteristics over a prolonged priod of time free of deterioration despite lapse of time.

Further, the photosensitive member was 2.4 in optical energy gap (Egopt) and 3.3 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 23

The photosensitive member was prepared by the same manner as in Example 21 except that the flow rate of acetone gas was set to 15 sccm in CTL step.

When subjeted to CHN quantitative analysis, the a-C layer thus obtained was found to contain 40 atomic % of hydrogen atoms based on the combined amount of carbon atoms and hydrogen atoms and 3.1 atomic % of oxygen atoms based on all the constituent atoms therein. The thickness of the member was about 17.6 microns.

Characteristics

When the photosensitive member obtained was used for the usual Carlson process, the member showed a Vmax of +1000V, indicating that the member had satisfactory charging properties.

The period of time required for dark decay from +600 V to +550 V was about 25 seconds, showing that the member had satisfactory charge retentivity.

When the member was initially charged to +500 V and thereafter exposed to white light to decay the charge to +100 V, the amount of light required for the light decay was about 9.3 lux-sec. This revealed that the member was satisfactory in photosensitive characteristics. The amount of light required for the light decay as described above was about 10 lux-sec. after three months upon the formation of the present photosensitive member. This showed that the member had stabilized characteristics over a prolonged priod of time free of deterioration despite lapse of time.

Further, the photosensitive member was 2.6 in optical energy gap (Egopt) and 3.1 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 24

The photosensitive member was prepared by the same manner as in Example 21 except that the flow rate of acetone gas was set to 40 sccm and the temperature of the second heater 723 was set to 35° C. in CTL step.

When subjeted to CHN quantitative analysis, the a-C layer thus obtained was found to contain 42 atomic % of hydrogen atoms based on the combined amount of carbon atoms and hydrogen atoms and 7.8 atomic % of oxygen atoms based on all the constituent atoms therein. The thickness of the member was about 16.4 microns.

Characteristics

When the photosensitive member obtained was used for the usual Carlson process, the member showed a Vmax of +700 V. Specifically, the C.A. of the member was about 42 V by calculating from the entire thickness, i.e., 16.7 microns, indicating that the member had satisfactory charging properties.

The period of time required for dark decay from +600 V to +550 V was about 25 seconds, showing that the member had satisfactory charge retentivity.

When the member was initially charged to +500 V and thereafter exposed to white light to decay the charge to +100 V, the amount of light required for the light decay was about 18.8 lux-sec. This revealed that the member was satisfactory in photosensitive characteristics. The amount of light required for the light decay as described above was about 20.3 lux-sec. after three months upon the formation of the present photosensitive member. This showed that the member had stabilized characteristics over a prolonged priod of time free of deterioration despite lapse of time.

Further, the photosensitive member was 3.1 in optical energy gap (Egopt) and 3.0 in relative dielectric constant.

These results indicate that the photosensitive member prepared in the present example according to the invention exhibits outstanding performance, although the member of the present example was slightly lower in electrostatic characteristics than those of Examples 21 to 23. When the member was used in the Carlson process for forming images thereon, followed by image transfer, sharp copy images were obtained.

COMPARATIVE EXAMPLE 11

The photosensitive member was prepared by exactly the same process as in Example 21 except that acetone gas was not introduced in CTL step.

When subjeted to CHN quantitative analysis, the a-C layer thus obtained was found to contain 46 atomic % of hydrogen atoms based on the combined amount of carbon atoms and hydrogen atoms. However, the oxygen atoms was not found in the a-C layer. Moreover, the thickness of the a-C layer was 19.7 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 7.2 lux-sec. On the other hand, the member did not attain a half-reduced value with the light exposure of about 50 lux-sec. after three months upon the formation of the present photosensitive member. This showed that the member was poor in stabilized characteristics over a prolonged priod of time free of deterioration despite lapse of time. This substantiates the superiority of the a-C layer of the invention prepared by doping preferable amount of oxygen.

COMPARATIVE EXAMPLE 12

The photosensitive member was prepared by exactly the same process as in Example 21 except that the flow rate of acetone gas was set to 60 sccm and the temperature of the second heater 723 was set to 40° C. in CTL step.

The a-C layer thus obtained was poor in ability for film-forming and the charge transporting layer in a solid state could hardly be obtained. The thickness could not be accurately obtained.

When subjeted to CHN quantitative analysis, the thin a-C layer thus obtained was found to contain 42 atomic % of hydrogen atoms based on the combined amount of carbon atoms and hydrogen atoms and 8.0 atomic % of oxygen atoms based on all the constituent atoms therein.

As apparent from the above, the amount of oxygen contained in the charge transporting layer was important in view of the film-forming.

EXAMPLE 25

Using an apparatus for practicing the present invention, a photosensitive member was prepared, the member comprising an electrically conductive substrate, a charge generating layer and a charge transporting layer provided in this order as shown in FIG. 2.

Charge Generating Layer Forming Step (CGL)

A photosensitive layer comprising Se-As alloy and having a thickness of about 3 microns was formed on a substrate 752, which was an aluminum substrate having a diameter of 80 mm and a length of 330 mm, with a vacuum evaporation apparatus.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, 1,3-butadiene gas from the second tank 702 into the second flow controller 714 and carbon dioxide gas from the third tank 703 into the third flow controller 715, each at an output pressure of 1.0 kg/cm$^2$. The dials on the flow controllers were adjusted to supply the hydrogen gas at a flow rate of 180 sccm, the 1,3-butadiene gas at 180 sccm and the carbon dioxide gas at 15 sccm to the reactor 733 through the main pipe 732 via the intermediate mixer 731. After the flows of the gases were stabilized, the internal pressure of the reactor 733 was adjusted to 2.0 torr by the pressure control valve 745. On the other hand, the substrate 752, on which the Se-As charge generating layer was formed, was preheated to 50° C. With the gas flow rates and the pressure in stabilized state, 200-watt power with a frequency of 170 KHz was applied to the power application electrode 736 from the low-frequency power source 741 which was connected to the electrode by the connection selecting switch 744 in advance to conduct plasma polymerization for 20 minutes, forming an a-C layer, 10 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 45 atomic % of hydrogen atoms based on the combined amount of carbon atoms and hydrogen atoms and 1.7 atomic % of oxygen atoms based on all the constituent atoms therein.

Characteristics

When the photosensitive member obtained was used for the usual Carlson process, the member showed a Vmax of −900 V. Specifically, the C.A. of the member was 69 V by calculating from the entire thickness of the member, i.e. 13 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 4.2 lux-sec. This revealed that the member was satisfactory in photosensitive characteristics. The amount of light required for the light decay as described above was about 4.3 lux-sec. after three months upon the formation of the present photosensitive member. This showed that the member had stabilized characteristics over a prolonged priod of time free of deterioration despite lapse of time.

Further, the photosensitive member was 2.4 in optical energy gap (Egopt) and 3.2 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 26

Using an apparatus for practicing the present invention, a photosensitive member was prepared, the member comprising an electrically conductive substrate, a charge generating layer and a charge transporting layer provided in this order as shown in FIG. 2.

CGL (a-Si) Step

The vacuum evaporation apparatus (not shown) was used. First, the interior of the apparatus was evacuated to a vacuum of about less than $10^{-5}$ Torr, and AlClPc(Cl) was evaporated on a substrate, which was an aluminum substrate measuring 50 mm in length, 50 mm in width and 3 mm in thickness, under a boat temperature of about 400° to 550° C. for 5 minutes to form an AlClPc(Cl) charge generating layer in a thickness of about 400 angstrom.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, 1,3-butadiene gas from the second tank 702 into the second flow controller 714 and nitrogen gas from the third tank 703 into the third flow controller 715, each at an output pressure of 1.0 kg/cm$^2$. The dials on the flow controllers were adjusted to supply the hydrogen gas at a flow rate of 70 sccm, the 1,3-butadiene gas at 30 sccm and the nitrogen gas at 15 sccm to the reactor 733 through the main pipe 732 via the intermediate mixer 731. After the flows of the gases were stabilized, the internal pressure of the reactor 733 was adjusted to 2.0 torr by the pressure control valve 745. On the other hand, the substrate 752, on which the AlClPc(Cl) charge generating layer was formed, was preheated to 70° C. With the gas flow rates and the pressure in stabilized state, 120-watt power with a frequency of 120 KHz was applied to the power application electrode 736 from the low-frequency power source 741 which was connected to the electrode by the connection selecting switch 744 in advance to conduct plasma polymerization for 15 minutes, forming an a-C layer, 7 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 46 atomic % of hydrogen atoms based on the combined amount of carbon atoms and hydrogen atoms and 1.1 atomic % of nitrogen atoms based on all the constituent atoms therein.

Characteristics

When the photosensitive member obtained was used for the usual Carlson process, the member showed a Vmax of −600 V. Specifically, the C.A. of the member was 86 V by calculating from the entire thickness of the member, i.e. 7.0 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to monochromatic light of 780 nm by spectroscopic filter to decay the charge to −100 V, the amount of light required for the light decay was about 12.8 erg/cm$^2$. This revealed that the member was satisfactory in photosensitive characteristics. The amount of light required for the light decay as described above was about 13.4 erg/cm$^2$ after three months upon the formation of the present photosensitive member. This showed that the member had stabilized characteristics over a prolonged priod of time free of deterioration despite lapse of time.

Further, the photosensitive member was 2.3 in optical energy gap (Egopt) and 3.4 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 27

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, propylene gas from the second tank 702 into the second flow controller 714 and diborane gas which was diluted to the concentration of 5% with hydrogen gas from the third tank 703 into the third flow controller 715, each at an output pressure of 1.0 kg/cm$^2$. At the same time, the eighth regulator valve 726 was opened, and acetone gas, heated at a temperature of 30° C. by the second heater 723 was introduced into the eighth flow controller 729 from the second container 720. The dials on the flow controllers were adjusted to supply the hydrogen gas at a flow rate of 200 sccm, the propylene gas at 150 sccm, the diborane gas which was diluted to the concentration of 5% with hydrogen gas at 60 sccm and acetone gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 350 mm, was preheated to 200° C. With the gas flow rates and the pressure in stabilized state, 250-watt power with a frequency of 13.56 MHz was applied to the power application electrode 736 from the high-frequency power source 739 which was connected to the electrode by the connection selecting switch 744 in advance to conduct plasma polymerization for 2.5 hours, forming an a-C layer, 18.4 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 45 atomic % of hydrogen atoms based on the combined amount of carbon atoms and hydrogen atoms, 1.1 atomic % of oxygen atoms and 2 atomic % of diborane gas based on all the constituent atoms therein.

The ratio of $\alpha_3$ to $\alpha_4$ was measured with the infrared absorption spectrum within the range of 4000 cm$^{-1}$ to 450 cm$^{-1}$ using Infrared Fourier Transform Spectrometer 1710 ( made by Perkin-Elmer Co., Ltd.). The obtained ratio of $\alpha_3$ to a $\alpha_4$ was 0.63.

Charge Generating Layer Forming Step (CGL)

Next, the first, fourth, fifth and sixth regulator valves 707, 710, 711 and 712 were opened to introduce hydrogen gas from the first tank 701 into the first flow controller 713, nitrous oxide gas from the fourth tank 704 into the fourth flow controller 716, phosphine gas which was diluted to the concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm, the nitrous oxide gas at 1.0 sccm, the phosphine gas diluted to the concentration of 50 ppm with hydrogen gas at a flow rate of 4 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 250° C. With the gas flow rates and the pressure in stabilized state, 200-watt power with a frequency of 13.56 MHz was applied to the power application electrode 736 from the high-frequency power source 739 to effect glow discharge for 5 minutes, whereby a charge generating a-Si:B:H layer was formed with a thickness of 0.3 microns. Characteristics:

When the photosensitive member obtained was used for the usual Carlson process, the member showed a Vmax of +1000 V, indicating that the member had satisfactory charging properties.

The period of time required for dark decay from +600 V to +550 V was about 15 seconds, showing that the member had satisfactory charge retentivity.

When the member was initially charged to +500 V and thereafter exposed to white light to decay the charge to +100V, the amount of light required for the light decay was about 5.0 lux-sec. This revealed that the member was satisfactory in photosensitive characteristics. The amount of light required for the light decay as described above was about 5.5 lux-sec. after three months upon the formation of the present photosensitive member. This showed that the member had stabilized characteristics over a prolonged priod of time free of deterioration despite lapse of time.

Further, the photosensitive member was 2.6 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 28

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about 10$^{-6}$ torr, and the first, second and third regulator valves 707, 708 and 709 were thereafter opened to introduce hydrogen gas from the first tank 701 into the first flow controller 713, propylene gas from the second tank 702 into the second flow controller 714 and diborane gas which was diluted to the concentration of 5% with hydrogen gas from the third tank 703 into the third flow controller 715, each at an output pressure of 1.0 kg/cm$^2$. At the same time, the seventh and eighth regulator valves 725 and 726 were opened, and styrene gas, heated at a temperature of 70° C. by the first heater 722 was introduced into the seventh flow controller 728 from the first container 719 and acetone gas, heated at 30° C. by the second heater 723 was introduced into the eighth flow controller 729 from the second container 720. The dials on the flow controllers were adjusted to supply the hydrogen gas at a flow rate of 200 sccm, the propylene gas at 150 sccm, the diborane gas which was diluted to the concentration of 5% with hydrogen gas at 80 sccm, styrene gas at 50 sccm and acetone gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 350 mm, was preheated to 200° C. With the gas flow rates and the pressure in stabilized state, 250-watt power with a frequency of 13.56 MHz was applied to the power application electrode 736 from the high-frequency power source 739 which was connected to the electrode by the connection selecting switch 744 in advance to conduct plasma polymerization for 2 hours, forming an a-C layer, 19.5 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 46 atomic % of hydrogen atoms based on the combined amount of carbon atoms and hydrogen atoms, 0.8 atomic % of oxygen atoms and 2 atomic % of diborane gas based on all the constituent atoms therein.

Charge Generating Layer Forming Step (CGL)

The a-Si:B:H charge generating layer having a thickness of about 0.3 microns was formed by the same process as in EXAMPLE 9.

Characteristics

When the photosensitive member obtained was used for the usual Carlson process, the member showed a Vmax of +1000 V, indicating that the member had satisfactory charging properties.

The period of time required for dark decay from +600 V to +550 V was about 18 seconds, showing that the member had satisfactory charge retentivity.

When the member was initially charged to +500 V and thereafter exposed to white light to decay the charge to +100 V, the amount of light required for the light decay was about 5.5 lux-sec. This revealed that the member was satisfactory in photosensitive characteristics. The amount of light required for the light decay as described above was about 5.8 lux-sec. after three months upon the formation of the present photosensitive member. This showed that the member had stabilized characteristics over a prolonged priod of time free of deterioration despite lapse of time.

Further, the photosensitive member was 2.6 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

As apparent from the above, the a-C layer containing preferable amount of oxygen exhibits improved photosensitivity by doping elements of Group IIIA at the Periodic Table.

EXAMPLE 29

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, etylene gas from the second tank 702 into the second flow controller 714, nitrogen gas from the third tank 703 into the third flow controller 715 and phosphine gas which was diluted to the concentration of 5% with hydrogen gas from the fourth tank 704 into the fourth flow controller 716, each at an output pressure of 1.0 kg/cm$^2$. The dials on the flow controllers were adjusted to supply the hydrogen gas at a flow rate of 40 sccm, the etylene gas at 30 sccm, the nitrogen gas at 15 sccm and the phosphine gas which was diluted to the concentration of 5% by hydrogen gas at 12 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 250° C. With the gas flow rates and the pressure in stabilized state, 200-watt power with a frequency of 13.56 MHz was applied to the power application electrode 736 from the high-frequency power source 739 which was connected to the electrode by the connection selecting switch 744 in advance to conduct plasma polymerization for 5 hours, forming an a-C layer, 7.0 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 52 atomic % of hydrogen atoms based on the combined amount of carbon atoms and hydrogen atoms, 1.2 atomic % of nitrogen atoms and 2 atomic % of phosphine gas based on all the constituent atoms therein.

Charge Generating Layer Forming Step (CGL)

The a-Si:B:H charge generating layer having a thickness of about 0.3 microns was formed by the same process as in Example 9.

Characteristics

When the photosensitive member obtained was used for the usual Carlson process, the member showed a Vmax of −600 V. Specifically, The C.A. of the member was about 82 V by calculating from the entire thickness of the member, i.e., 7.3 microns, indicating that the member had satisfactory charging properties.

The period of time required for dark decay from −600 V to −550 V was about 14 seconds, showing that the member had satisfactory charge retentivity.

When the member was initially charged to −500 V and thereafter exposed to white light to decay the charge to −100 V, the amount of light required for the light decay was about 6.8 lux-sec. This revealed that the member was satisfactory in photosensitive characteristics. The amount of light required for the light decay as described above was about 7.2 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

As apparent from the above, the a-C layer containing preferable amount of oxygen exhibits improved photosensitivity by doping elements of Group VA at the Periodic Table.

EXAMPLE 30

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, butadiyne gas from the second tank 702 into the second flow controller 714, nitrogen gas from the third tank 703 into the third flow controller 715 and oxygen gas from the fourth tank 704 into the fourth flow controller 716, each at an output pressure of 1.0 kg/cm$^2$. The dials on the flow controllers were adjusted to supply the hydrogen gas at a flow rate of 150 sccm, the butadiyne gas at 50 sccm, the nitrogen gas at 4 sccm and the oxygen gas at 21 sccm to the reactor 733 through the main pipe 732 via the intermediate mixer 731. After the flows of the gases were stabilized, the internal pressure of the reactor 733 was adjusted to 1.2 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 60-watt power with a frequency of 13.56 MHz was applied to the power application electrode 736 from the high-frequency power source 739 preconnected thereto by the selecting switch 744 to conduct plasma polymerization for 50 minutes, forming an a-C layer, 14.2 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 42.3 atomic % of hydrogen atoms based on the combined amount of carbon atoms and hydrogen atoms and 1.1 atomic % of nitrogen atoms and 4.9 atomic % of oxygen atoms based on all the constituent atoms therein.

The ratio of $\alpha_3$ to $\alpha_4$ was measured with the infrared absorption spectrum within the range of 4000 cm$^{-1}$ to 450 cm$^{-1}$ using Infrared Fourier Transform Spectrometer 1710 ( made by Perkin-Elmer Co., Ltd.). The obtained ratio of $\alpha_3$ to $\alpha_4$ was 0.83.

CGL (a-Si) Step

The a-Si:H charge generating layer having a thickness of 0.3 microns was subsequently formed by the same manner as in Example 1.

Characteristics

When the photosensitive member obtained was used for the usual Carlson process, the member showed a Vmax of −600 V. Specifically, the C.A. of the member was about 41.4 V by calculating from the entire thickness of the member, i.e., 14.5 microns, indicating that the member had satisfactory charging properties.

The period of time required for dark decay from −600 V to −500 V was about 15 seconds, showing that the member had satisfactory charge retentivity.

When the member was initially charged to −500 V and thereafter exposed to white light to decay the charge to −100 V, the amount of light required for the light decay was about 7.8 lux-sec. This revealed that the member was satisfactory in photosensitive characteristics. The amount of light required for the light decay as described above was about 8.1 lux-sec. after three months upon the formation of the present photosensitive member. This showed that the member had stabilized characteristics over a prolonged priod of time free of deterioration despite lapse of time.

Further, the photosensitive member was 2.5 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 31

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, isoprene gas from the second tank 702 into the second flow controller 714 and nitrous oxide gas from the third tank 703 into the third flow controller 715, each at an output pressure of 1.0 kg/cm$^2$. The dials on the flow controllers were adjusted to supply the hydrogen gas at a flow rate of 90 sccm, the isoprene gas at 40 sccm and the nitrous oxide gas at 15 sccm to the reactor 733 through the main pipe 732 via the intermediate mixer 731. After the flows of the gases were stabilized, the internal pressure of the reactor 733 was adjusted to 2.0 torr by the pressure control valve 745. On the other hand, the substrate 752, which was an aluminum substrate measuring 50 mm in length, 50 mm in width and 3 mm in thickness, was preheated to 130° C. With the gas flow rates and the pressure in stabilized state, 200-watt power with a frequency of 500 KHz was applied to the power application electrode 736 from the high-frequency power source 739 preconnected thereto by the selecting switch 744 to conduct plasma polymerization for 30 minutes, forming an a-C layer, 11.4 microns in thickness, as a charge transporting layer on the substrate, whereupon the power supply was discontinued, the regulator valves were closed, and the reactor 733 was fully exhausted.

When subjeted to CHN quantitative analysis, the a-C layer thus obtained was found to contain 35 atomic % of hydrogen atoms based on the combined amount of carbon atoms and hydrogen atoms and 1.3 atomic % of nitrogen atoms and 1.4 atomic % of oxygen atoms based on all the constituent atoms therein.

The ratio of $\alpha_3$ to $\alpha_4$ was measured with the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_3$ to $\alpha_4$ was 0.57.

CGL (a-Si) Step

The a-Si:H charge generating layer having a thickness of Example 1. 0.3 microns was subsequently formed by the same manner as in

Characteristics

When the photosensitive member obtained was used for the usual Carlson process, the member showed a Vmax of −600 V. Specifically, the C.A. of the member was about 51.3 V by calculating from the entire thickness of the member, i.e., 11.7 microns, indicating that the member had satisfactory charging properties.

The period of time required for dark decay from −600 V to −550 V was about 13 seconds, showing that the member had satisfactory charge retentivity.

When the member was initially charged to −500V and thereafter exposed to white light to decay the charge to −100 V, the amount of light required for the light decay was about 5.8 lux-sec. This revealed that the member was satisfactory in photosensitive characteristics. The amount of light required for the light decay as described above was about 6.1 lux-sec. after three months upon the formation of the present photosensitive member. This showed that the member had stabilized characteristics over a prolonged priod of time free of deterioration despite lapse of time.

Further, the photosensitive member was 2.4 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 13

The photosensitive member was prepared by exactly the same process as in Example 1 except that the charge generating layer forming step was not performed. Therefore, the member comprises only the charge transporting layer on the substrate.

The amount of hydrogen and nitrogen and the value of Egopt and relative dielectric constant in the present a-C layer were the same as those in Example 1.

Characteristics

The charging characteristics of the photosensitive member thus obtained was almost the same as that of Example 1.

However, when the member was exposed with white light or light having the wavelength of 450 nm and the amount of 50 erg/$cm^2$, the light decay characteristics could not be observed.

COMPARATIVE EXAMPLE 14

The photosensitive member was prepared by exactly the same process as in Example 13 except that the charge generating layer forming step was not performed. Therefore, the member comprises only the charge transporting layer on the substrate.

The amount of hydrogen and oxygen and the value of Egopt and relative dielectric constant in the present a-C layer were the same as those in Example 13.

Characteristics

The charging characteristics of the photosensitive member thus obtained was almost the same as that of Example 13.

However, when the member was exposed with white light or light having the wavelength of 450 nm and the amount of 50 erg/$cm^2$, the light decay characteristics could not be observed.

COMPARATIVE EXAMPLE 14

The photosensitive member was prepared by exactly the same process as in Example 30 except that the charge generating layer forming step was not performed. Therefore, the member comprises only the charge transporting layer on the substrate.

The amount of hydrogen, nitrogen and oxygen and the value of Egopt and relative dielectric constant in the present a-C layer were the same as those in Example 30.

Characteristics

The charging characteristics of the photosensitive member thus obtained was almost the same as that of Example 30.

However, when the member was exposed with white light or light having the wavelength of 450 nm and the amount of 50 erg/$cm^2$, the light decay characteristics could not be observed.

What is claimed is:

1. A photosensitive member comprising:
an electrically conductive substrate;
a charge generating layer; and
a charge transporting layer comprising amorphous carbon containing hydrogen in an amount of about 0.1 to about 67 atomic % based on the combined amount of hydrogen and carbon, said charge transporting layer containing at least one of oxygen in an amount of about 0.1 to about 7 atomic % and nitrogen in an amount of about 0.1 to about 5 atomic % based on all the constituent atoms in the layer and having a relative dielectric constant of about 2.0 to about 6.0.

2. A photosensitive member as claimed in claim 1 wherein said charge transporting layer has essentially no photoconductivity.

3. A photosensitive member as claimed in claim 1 wherein said charge transporting layer is prepared by organic plasma polymerization.

4. A photosensitive member as claimed in claim 1 wherein the amount of the oxygen contained in the charge transporting layer is preferably about 0.1 to about 4.7 atomic % based on all the constituent atoms therein.

5. A photosensitive member as claimed in claim 1 wherein the amount of the nitrogen contained in the charge transporting layer is preferably about 0.1 to about 3.9 atomic % based on all the constituent atoms therein.

6. A photosensitive member as claimed in claim 1 wherein the charge transporting layer has an optical energy gap of about 1.5 to about 3.0.

* * * * *